US010714847B2

(12) United States Patent
Youtsey

(10) Patent No.: US 10,714,847 B2
(45) **Date of Patent: *Jul. 14, 2020**

(54) COAXIAL CABLE CONNECTOR WITH COMPRESSION COLLAR AND DEFORMABLE COMPRESSION BAND

(71) Applicant: PCT International, Inc., Mesa, AZ (US)

(72) Inventor: Timothy L. Youtsey, Tempe, AZ (US)

(73) Assignee: PCT International, Inc., Mesa ( * ) Notice: Subject to any disclaimer, the term of this patent is extended or adjusted under 35 U.S.C. 154(b) by 0 days.

This patent is subject to a terminal disclaimer.

(21) Appl. No.: 16/418,795

(22) Filed: May 21, 2019

(65) Prior Publication Data

US 2019/0273333 A1 Sep. 5, 2019

Related U.S. Application Data

(63) Continuation of application No. 15/850,344, filed on Dec. 21, 2017, now Pat. No. 10,348,005, which is a continuation-in-part of application No. 15/160,862, filed on May 20, 2016, now Pat. No. 9,876,288, which is a continuation of application No. 14/275,219, filed on May 12, 2014, now Pat. No. 9,373,902, which is a continuation-in-part of application No. 13/739,972, filed on Jan. 11, 2013, now Pat. No. 9,039,446.

(60) Provisional application No. 62/674,567, filed on May 21, 2018, provisional application No. 61/658,087, filed on Jun. 11, 2012.

(51) Int. Cl.
*H01R 9/05* (2006.01)
*H01R 103/00* (2006.01)

(52) U.S. Cl.
CPC ..... *H01R 9/0524* (2013.01); *H01R 2103/00* (2013.01)

(58) Field of Classification Search
CPC ..... H01R 9/0524; H01R 2103/00; H01R 9/0521; H01R 9/05; H01R 24/564
USPC ..... 439/584
See application file for complete search history.

(56) References Cited

U.S. PATENT DOCUMENTS

| | | | | |
|---|---|---|---|---|
| 2,367,175 | A | 1/1945 | Hahn | |
| 2,754,487 | A | 7/1956 | Carr et al. | |
| 3,199,061 | A | 8/1965 | Johnson et al. | |
| 4,225,162 | A * | 9/1980 | Dola | F16L 33/225 285/139.1 |
| 4,377,320 | A | 3/1983 | Lathrop et al. | |
| 4,629,272 | A | 12/1986 | Mattingly et al. | |
| 4,990,104 | A | 2/1991 | Schieferly | |

(Continued)

*Primary Examiner* — Abdullah A Riyami
*Assistant Examiner* — Vladimir Imas
(74) *Attorney, Agent, or Firm* — Thomas W. Galvani, P.C.; Thomas W. Galvani

(57) ABSTRACT

A coaxial cable connector includes a barrel having a longitudinal axis, a front end, and an annular sidewall extending rearwardly from the front end of the barrel along the longitudinal axis. A compression band is formed in the sidewall and includes a thinned portion of the sidewall and annular first and second ridges flanking the thinned portion. An annular forward ridge is formed in the sidewall in front of the first ridge. A compression collar is mounted to the barrel for axial movement between a retracted position and an advanced position in which the sidewall is deformed radially inward only at the compression band.

26 Claims, 24 Drawing Sheets

(56) References Cited

U.S. PATENT DOCUMENTS 4,990,106 A 2/1991 Szegda
5,466,173 A 11/1995 Down
5,498,175 A 3/1996 Yeh et al.
5,501,616 A 3/1996 Holliday
5,879,191 A 3/1999 Burris
5,975,951 A * 11/1999 Burris ..... H01R 13/5202 439/322
5,993,254 A * 11/1999 Pitschi ..... H01R 9/0521 439/584
5,997,350 A * 12/1999 Burris ..... H01R 9/0521 285/249
6,010,289 A 1/2000 Distasio et al.
6,042,422 A * 3/2000 Youtsey ..... H01R 9/0518 439/585
6,089,912 A 7/2000 Tallis et al.
6,153,830 A * 11/2000 Montena ..... H01R 9/0521 174/88 C
6,217,383 B1 4/2001 Holland et al.
6,425,782 B1 * 7/2002 Holland ..... H01R 9/0521 439/578
6,648,683 B2 11/2003 Youtsey
6,712,631 B1 3/2004 Youtsey
6,729,912 B2 5/2004 D'Addario
6,767,248 B1 * 7/2004 Hung ..... H01R 13/5205 439/578
6,848,939 B2 * 2/2005 Stirling ..... H01R 9/0521 439/578
7,008,263 B2 3/2006 Holland
7,018,235 B1 * 3/2006 Burris ..... H01R 9/0518 439/578
7,021,965 B1 * 4/2006 Montena ..... H01R 9/0518 439/578
7,063,565 B2 * 6/2006 Ward ..... H01R 9/0524 439/578
7,125,283 B1 * 10/2006 Lin ..... H01R 9/0518 439/578
7,128,603 B2 * 10/2006 Burris ..... H01R 9/0521 439/578
7,144,272 B1 12/2006 Burris et al.
7,182,639 B2 * 2/2007 Burris ..... H01R 9/0518 439/578
7,252,546 B1 * 8/2007 Holland ..... H01R 9/0524 439/584
7,288,002 B2 * 10/2007 Rodrigues ..... H01R 9/0521 439/439
7,354,307 B2 * 4/2008 Chee ..... H01R 9/0521 439/272
7,364,462 B2 * 4/2008 Holland ..... H01R 9/0527 439/578
7,377,809 B2 5/2008 Dyck
7,387,531 B2 6/2008 Cook
7,395,166 B2 7/2008 Plishner
7,404,373 B2 7/2008 Bailey
7,404,737 B1 7/2008 Youtsey
7,410,389 B2 8/2008 Holliday
7,458,851 B2 * 12/2008 Montena ..... H01R 9/0521 439/584
7,510,432 B2 3/2009 Entsfellner
7,527,524 B1 5/2009 Coleman et al.
7,568,944 B1 * 8/2009 Linan ..... H01R 4/10 439/578
7,753,727 B1 7/2010 Islam et al.
7,845,978 B1 * 12/2010 Chen ..... H01R 9/0521 439/578
7,934,953 B1 5/2011 Solis
7,955,088 B2 6/2011 Di Stefano
7,976,339 B2 7/2011 Buck et al.
8,029,316 B2 10/2011 Snyder et al.
8,038,471 B2 10/2011 Malak
8,075,339 B2 * 12/2011 Holliday ..... H01R 9/0518 439/584
8,118,612 B2 2/2012 Morikawa
8,137,132 B2 * 3/2012 Lu ..... H01R 9/0524 439/578
8,167,635 B1 * 5/2012 Mathews ..... H01R 24/40 439/277
8,272,893 B2 * 9/2012 Burris ..... H01R 9/0524 439/578
8,287,320 B2 * 10/2012 Purdy ..... H01R 13/6592 439/792
8,337,229 B2 12/2012 Montena
8,348,697 B2 * 1/2013 Zraik ..... H01R 13/502 439/321
8,366,481 B2 * 2/2013 Ehret ..... H01R 9/05 439/578
8,444,433 B2 5/2013 Snyder et al.
8,469,739 B2 6/2013 Rodrigues et al.
8,491,334 B2 * 7/2013 Rodrigues ..... H01R 9/0524 439/584
8,556,656 B2 * 10/2013 Thomas ..... H01R 9/0521 439/584
8,568,164 B2 10/2013 Ehret et al.
8,579,658 B2 11/2013 Youtsey
8,632,360 B2 * 1/2014 Tremba ..... H01R 9/0524 439/578
8,690,603 B2 4/2014 Bence et al.
8,753,147 B2 6/2014 Montena
8,801,448 B2 8/2014 Purdy et al.
8,834,200 B2 * 9/2014 Shaw ..... H01R 13/46 439/578
8,840,429 B2 9/2014 Thomas et al.
8,888,526 B2 * 11/2014 Burris ..... H01R 24/40 439/578
8,894,440 B2 11/2014 Rodrigues et al.
8,915,751 B2 12/2014 Wood
8,944,846 B2 2/2015 Lee
9,039,446 B2 * 5/2015 Youtsey ..... H01R 9/0524 439/584
9,048,599 B2 * 6/2015 Burris ..... H01R 24/38
9,071,019 B2 6/2015 Burris et al.
9,083,113 B2 7/2015 Wild et al.
9,257,780 B2 2/2016 Thomas et al.
2002/0164900 A1 11/2002 Youtsey
2004/0048514 A1 3/2004 Kodaira
2005/0148236 A1 7/2005 Montena
2007/0020973 A1 * 1/2007 Sattele ..... H01R 13/627 439/101
2007/0049113 A1 * 3/2007 Rodrigues ..... H01R 9/0524 439/578
2009/0053928 A9 2/2009 Entsfellner
2010/0261380 A1 10/2010 Skeels et al.
2010/0297875 A1 * 11/2010 Purdy ..... H01R 24/38 439/578
2012/0021642 A1 1/2012 Zraik
2012/0270439 A1 10/2012 Tremba et al.
2012/0329311 A1 12/2012 Duval et al.
2013/0072059 A1 3/2013 Purdy et al.
2013/0330967 A1 12/2013 Youtsey
2013/0337683 A1 12/2013 Chastain et al.
2014/0248798 A1 9/2014 Youtsey
2014/0342594 A1 11/2014 Montena
2015/0050825 A1 2/2015 Krenceski et al.
2015/0118901 A1 4/2015 Burris
2015/0162675 A1 6/2015 Davidson, Jr. et al.
2015/0180141 A1 6/2015 Wei

* cited by examiner

COAXIAL CABLE CONNECTOR WITH COMPRESSION COLLAR AND DEFORMABLE COMPRESSION BAND

CROSS-REFERENCE TO RELATED APPLICATIONS

This application claims the benefit of and is a continuation-in-part of pending U.S. patent application Ser. No. 15/850,344, filed Dec. 21, 2017, which claimed the benefit of and was a continuation-in-part of U.S. patent application Ser. No. 15/160,862, filed May 20, 2016, which claimed the benefit of and was a continuation of U.S. patent application Ser. No. 14/275,219, filed May 12, 2014, which claimed the benefit of and was a continuation-in-part of U.S. patent application Ser. No. 13/739,972, filed Jan. 11, 2013, which claimed the benefit of U.S. Provisional Application No. 61/658,087, filed Jun. 11, 2012, all of which are hereby incorporated by reference. This application also claims the benefit of U.S. Provisional Application No. 62/674,567, filed May 21, 2018, which is hereby incorporated by reference.

FIELD OF THE INVENTION

The present invention relates generally to electrical apparatus, and more particularly to coaxial cable connectors.

BACKGROUND OF THE INVENTION

Coaxial cables transmit radio frequency ("RF") signals between transmitters and receivers and are used to interconnect televisions, cable boxes, DVD players, satellite receivers, modems, and other electrical devices. Typical coaxial cables include an inner conductor surrounded by a flexible dielectric insulator, a foil layer, a conductive metallic tubular sheath or shield, and a polyvinyl chloride jacket. The RF signal is transmitted through the inner conductor. The conductive tubular shield provides a ground and inhibits electrical and magnetic interference with the RF signal in the inner conductor.

Coaxial cables must be fit with cable connectors to be coupled to electrical devices. Connectors typically have a connector body, a threaded fitting mounted for rotation on an end of the connector body, a bore extending into the connector body from an opposed end to receive the coaxial cable, and an inner post within the bore coupled in electrical communication with the fitting. Generally, connectors are crimped onto a prepared end of a coaxial cable to secure the connector to the coaxial cable. However, crimping occasionally results in a crushed coaxial cable which delivers a signal degraded by leakage, interference, or poor grounding. Furthermore, while some connectors are so tightly mounted to the connector body that threading the connector onto an electrical can be incredibly difficult, other connectors have fittings that are mounted so loosely on the connector body that the electrical connection between the fitting and the inner post can be disrupted when the fitting moves off of the post. An improved connector is needed.

SUMMARY OF THE INVENTION

A coaxial cable connector includes a barrel having a longitudinal axis, a front end, and an annular sidewall extending rearwardly from the front end of the barrel along the longitudinal axis. A compression band is formed in the sidewall and includes a thinned portion of the sidewall and annular first and second ridges flanking the thinned portion.

An annular forward ridge is formed in the sidewall in front of the first ridge. A compression collar is mounted to the barrel for axial movement between a retracted position and an advanced position in which the sidewall is deformed radially inward only at the compression band.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1:
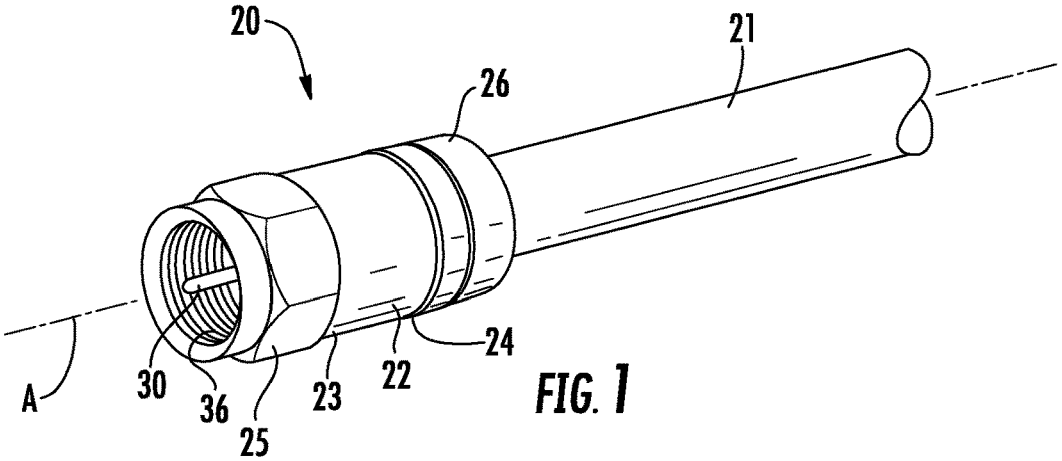
FIG. 1 is a perspective view of a coaxial cable connector having a fitting, an outer barrel, and a compression collar, the coaxial cable connector installed in a compressed condition applied to a coaxial cable.

Reference now is made to the drawings, in which the same reference characters are used throughout the different figures to designate the same elements. FIG. 1 illustrates a coaxial cable connector 20 constructed and arranged in accordance with the principles of the invention, as it would appear in a compressed condition crimped onto a coaxial cable 21. The embodiment of the connector 20 shown is an F connector for use with an RG6 coaxial cable for purposes of example, but it should be understood that the description below is also applicable to other types of coaxial cable connectors and other types of cables. The connector 20 includes a body 22 having opposed front and rear ends 23 and 24, a coupling nut or threaded fitting 25 mounted for rotation on the front end 23 of the body 22, and a compression collar 26 mounted to the rear end 24 of the body 22. The connector 20 has rotational symmetry with respect to a longitudinal axis A illustrated in FIG. 1. The coaxial cable 21 includes an inner conductor 30 and extends into the connector 20 from the rear end 24 in the applied condition of the connector 20. The inner conductor 30 extends through the connector 20 and projects beyond the fitting 25.

Figure 2A:
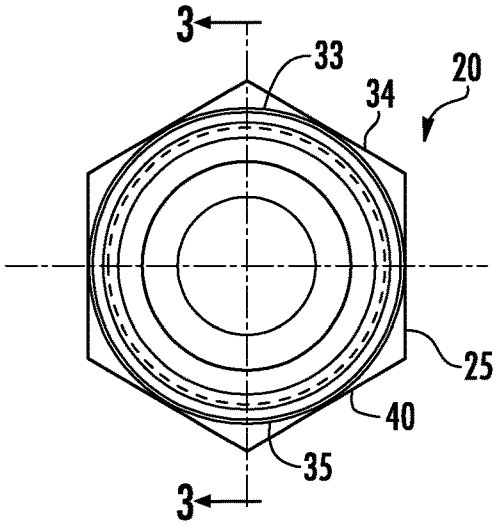
FIGS. 2A and 2B are front and side elevations, respectively, of the coaxial cable connector of FIG. 1.
Figure 2B:
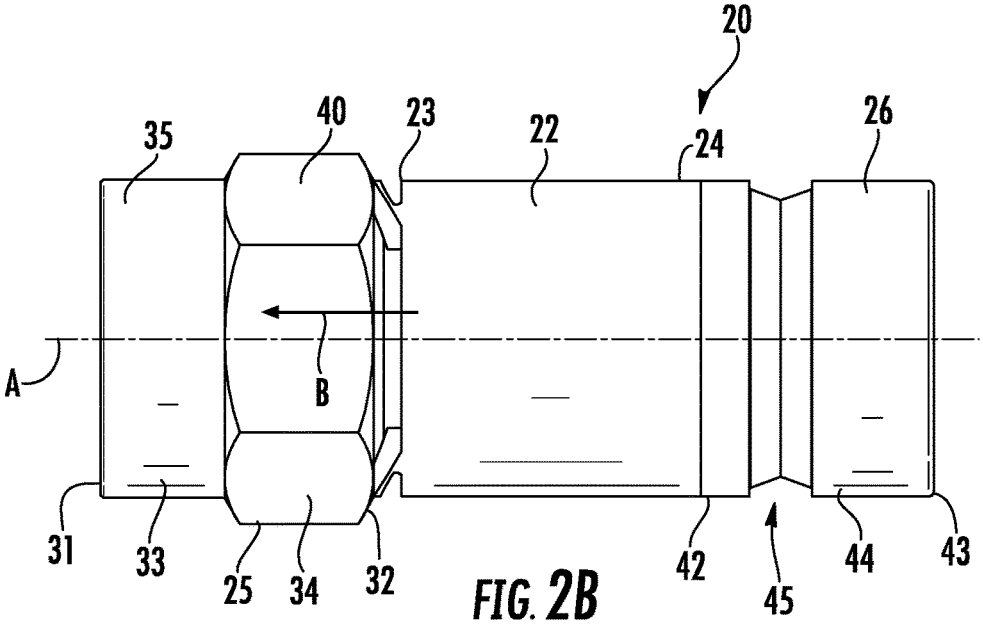
Figure 3A:
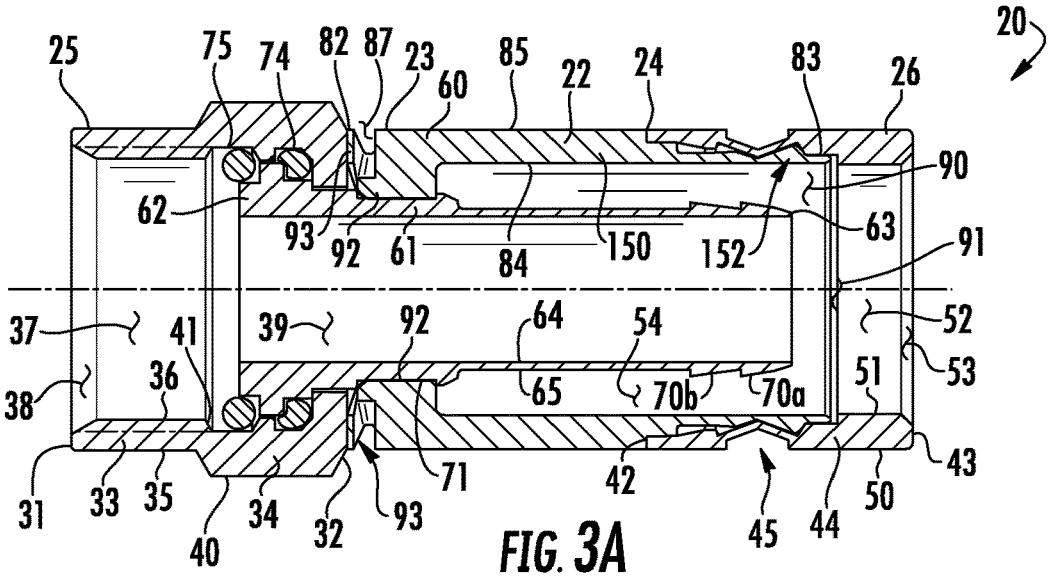
FIGS. 3A and 3B are section views of the coaxial cable connector of FIG. 1 taken along line 3-3 in FIG. 2A in an uncompressed condition and in a compressed condition, respectively.

FIGS. 2A and 2B show the connector 20 in greater detail in an uncompressed condition not applied to the coaxial cable 21. The fitting 25 is a sleeve having opposed front and rear ends 31 and 32, an integrally-formed ring portion 33 proximate to the front end 31, and an integrally-formed nut portion 34 proximate to the rear end 32. Referring also to FIG. 3A, the ring portion 33 has a smooth annular outer surface 35 and an opposed threaded inner surface 36 for engagement with an electrical device. Briefly, as a matter of explanation, the phrase "electrical device," as used throughout the description, includes any electrical device having a female post to receive a male coaxial cable connector 20 for the transmission of RF signals such as cable television, satellite television, internet data, and the like. The nut portion 34 of the fitting 25 has a hexagonal outer surface 40 to receive the jaws of a tool and an opposed grooved inner surface 41 (shown in FIG. 3A) to receive gaskets and to engage with the body 22 of the connector 20. Referring momentarily to FIG. 3A, an interior space 37 extends into the fitting 25 from a mouth 38 formed at the front end 31 of the fitting 25, to an opening 39 formed at the rear end 32, and is bound by the inner surfaces 36 and 41 of the ring and nut portions 33 and 34, respectively. Two annular channels 74 and 75 extend from the interior space 37 into the nut portion 34 from the inner surface 41 continuously around the nut portion 34. With reference back to FIG. 2B, the nut portion 34 of the fitting 25 is mounted on the front end 23 of the body 22 for rotation about axis A. The fitting 25 is constructed of a material or combination of materials having strong, hard, rigid, durable, and high electrically-conductive material characteristics, such as metal.

Referring still to FIG. 2B, the compression collar 26 has opposed front and rear ends 42 and 43, an annular sidewall 44 extending between the front and rear ends 42 and 43, and an annular outer compression band 45 formed in the sidewall 44 at a location generally intermediate along axis A between the front and rear ends 42 and 43 of the compression collar 26. Referring now to FIG. 3A, the compression collar 26 has a smooth annular outer surface 50 and an opposed smooth annular inner surface 51. An interior space 52 bound by the inner surface 51 extends into the compression collar 26 from a mouth 53 formed at the rear end 43 of the compression collar 26 to an opening 54 formed at the front end 42. The interior space 52 is a bore shaped and sized to receive the coaxial cable 21. The compression collar 26 is friction fit onto rear end 24 of the body 22 of the connector 22 proximate to the opening 54 to limit relative radial, axial, and rotational movement of the body 22 and the compression collar 26 about and along axis A, respectively. The compression collar 26 is constructed of a material or combination of materials having strong, hard, rigid, and durable material characteristics, such as metal, plastic, and the like.

With continuing reference to FIG. 3A, the body 22 of the connector 20 is an assembly including a cylindrical outer barrel 60 and a cylindrical, coaxial inner post 61 disposed within the outer barrel 60. The inner post 61 is an elongate sleeve extending along axis A and having rotational symmetry about axis A. The inner post 61 has opposed front and rear ends 62 and 63 and opposed inner and outer surfaces 64 and 65. The outer surface 65 at the rear end 63 of the inner post 61 is formed with two annular ridges 70*a* and 70*b* projecting toward the front end 62 and radially outward from axis A. As the term is used here, "radial" means aligned along a radius extending from the axis A. Moreover, the term "axial" means extending or aligned parallel to the axis A. The ridges 70*a* and 70*b* are spaced apart from each other along the rear end 63 of the inner post 61. The ridges 70*a* and 70*b* provide grip on a cable applied to the coaxial cable connector 20.

Figure 3B:
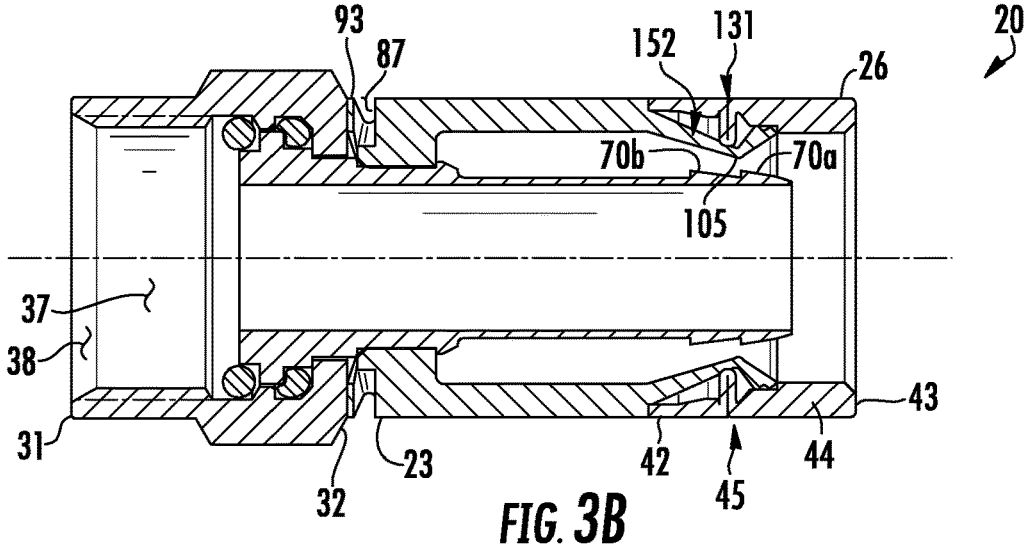
Figure 3C:
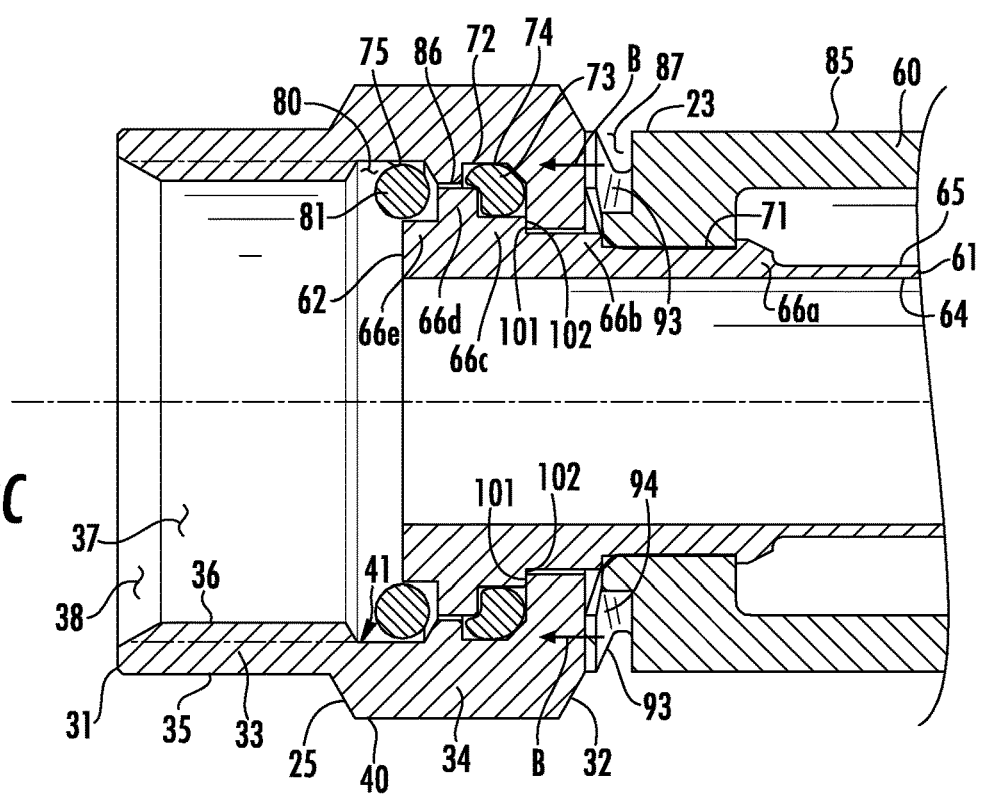
FIGS. 3C and 3D are enlarged section views of the coaxial cable connector of FIG. 1 taken along line 3-3 in FIG. 2A.

Referring now to the enlarged view of FIG. 3C, the outer surface 65 of the inner post 61 is formed with a series of outwardly-directed flanges 66*a*, 66*b*, 66*c*, 66*d*, and 66*e* spaced along the inner post 61 proximate to the front end 62. Each flange has a similar structure and projects radially away from the axis A; flanges 66*a* and 66*d* each include a front face directed toward the front end 62 of the inner post 61 and a rear face directed toward the rear end 63 of the inner post 61; flanges 66*b* and 66*c* each include a rear face directed toward the rear end 63 of the inner post 61; and flange 66*e* includes a front face directed toward the front end 62 of the inner post 61. Each of the flanges 66*a*-66*e* extends to a different radial distance away from the axis A. Flanges 66*a* and 66*b* form an annular dado or channel 71 around the inner post 61 defined between the front face of the flange 66*a* and the rear face of the flange 66*b*. The outer barrel 60 is coupled to the inner post 61 at the channel 71.

Referring still to FIG. 3C, the rear end 32 of the fitting 25 cooperates with the inner surface 41 of the nut portion 34 at the channel 74, the outer surface 65 of the inner post 61 at the flange 66*c*, and the rear face of the flange 66*d* to form a first toroidal volume 72 between the inner post 61 and the nut portion 34 for receiving a ring gasket 73. Additionally, the inner surface 41 of the nut portion 34 at the channel 75 cooperates with the front face of the flange 66*d* and the outer surface 65 of the inner post 61 at the flange 66*e* to form a second toroidal volume 80 between the inner post 61 and the nut portion 34 for receiving a ring gasket 81. The fitting 25 is supported and carried on the inner post 61 by the ring gaskets 73 and 81, and the ring gaskets 73 and 81 prevent the introduction of moisture into the connector 20. The inner post 61 is constructed of a material or combination of materials having hard, rigid, durable, and high electrically-conductive material characteristics, such as metal, and the ring gaskets 73 and 81 are constructed from a material or combination of materials having deformable, resilient, shape-memory material characteristics.

Returning now to FIG. 3A, the outer barrel 60 is an elongate, cylindrical sleeve extending along axis A with rotational symmetry about axis A. The outer barrel 60 has a sidewall 150 with opposed front and rear ends 82 and 83 and opposed inner and outer surfaces 84 and 85. The inner surface 84 defines and bounds an interior cable-receiving space 90 shaped and sized to receive the coaxial cable 21, and in which the rear end 63 of the inner post 61 is disposed. An opening 91 at the rear end 83 of the outer barrel 60 communicates with the interior space 52 of the compression collar 26 and leads into the interior cable-receiving space 90. The front end 82 of the outer barrel 60 is formed with an inwardly projecting annular lip 92. The lip 92 abuts and is received in the channel 71 in a friction-fit engagement, securing the outer barrel 60 on the inner post 61. The lip 92, together with the front end 23 of the body and the rear end 32 of the fitting 25, defines a circumferential groove 87 extending into the connector 20 from the outer surface 85 of the outer barrel 60.

Figure 2C:
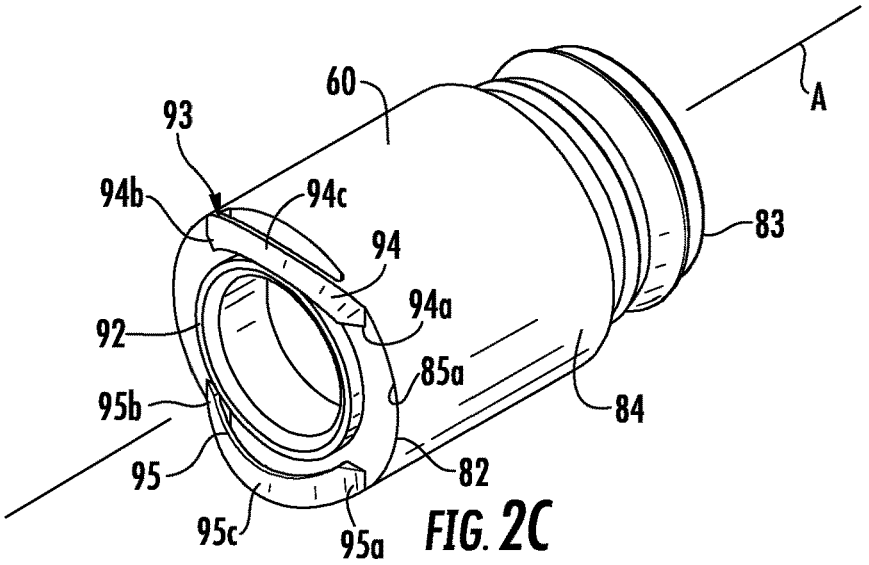
FIG. 2C is an isolated, perspective view of the outer barrel of the coaxial cable connector of FIG. 1.

The front end 82 of the outer barrel 60 is integrally formed with an alignment mechanism 93 disposed in the circumferential groove 87 between the outer barrel 60 and the fitting 25 to exert an axial force between the outer barrel 60 and the fitting 25 to maintain contact between the fitting 25 and the inner post 61 of the body 22. As seen in FIG. 2C, which illustrates the outer barrel 60 in isolation, the alignment mechanism 93 includes two springs 94 and 95 carried between the lip 92 and a perimeter 85*a* of the outer barrel 60 along the outer surface 84. The spring 94 is a quasi-annular leaf having opposed ends 94*a* and 94*b* and a middle 94*c*. The spring 95 is a quasi-annular leaf having opposed ends 95*a* and 95*b* and a middle 95*c*. As it is used here, "quasi-annular" means a shape which arcuately extends across an arcuate segment of a circle less than a full circle. The springs 94 and 95 are leafs, formed of a flat, thin, elongate piece of sprung material. The springs 94 and 95 are quasi-annular with respect to the axis A. The ends 94*a* and 94*b* of the spring 94 are fixed to the front end 82 of the outer barrel 60, and the middle 94*c* is free of the front end 82, projecting axially away from the outer barrel 60 toward the fitting 25, so that the spring 94 has an arcuate curved shape across a radial span and a convex shape in an axial direction. The spring 94 flexes along the axis A in response to axial compression and the spring 94 is maintained in a compressed condition in which the middle 94*c* is proximate to the front end 82. In the compressed condition of the springs 94, the middle 94*c* is disposed along the perimeter 85*a* between the side of the lip 92 and the outer surface 84 of the outer barrel 60, and the spring 94 exerts an axial bias forward on the fitting 25.

Similarly, the ends 95*a* and 95*b* of the spring 95 are fixed to the front end 82 of the outer barrel 60, and the middle 95*c* is free of the front end 82, projecting axially away from the outer barrel 60 toward the fitting 25, so that the spring 95 has an arcuate curved shape across a radial span and an convex shape in an axial direction. The spring 95 flexes along the axis A in response to axial compression and the spring 95 is maintained a compressed condition in which the middle 95*c* is proximate to the front end 82. In the compressed condition of the spring 95, the middle 95*c* is disposed between the side of the lip 92 and the outer surface 84 of the outer barrel 60, and the spring 95 exerts an axial bias forward on the fitting 25. In other embodiments, the alignment mechanism 93 includes several springs, or is a disc or annulus mounted on posts at the front end 23 of the outer barrel 60. Such alternate embodiments of the alignment mechanism 93 have an annularly sinusoidal or helicoid shaped about the axis A, and four forwardly-projecting, circumferentially spaced-apart contact points bearing against the fitting 25.

With reference now to FIG. 3C, the fitting 25 is mounted for free rotation on the inner post 61 about the axis A. To allow free rotation, the ring gaskets 73 and 81 space the nut portion 25 just off the inner post 61 in a radial direction, creating a gap 86 allowing for slight movement in the radial direction and allowing the fitting 25 to rotate with low rolling friction on the ring gaskets 73 and 81. When the fitting 25 is carried on the body 22 and is threaded onto or coupled to an electrical device, the alignment mechanism 93 is maintained in a compressed state, and the force exerted by the alignment mechanism 93 urges the fitting 25 in a forward direction along line B in FIG. 3C, causing the alignment mechanism 93 to bear against the fitting 25 and causing a contact face 101 on the rear end 32 of the fitting 25 to contact the rear face of the flange 66*c*, which is a contact face 102. The forwardly-directed force exerted by the alignment mechanism 93 overcomes the resistant spring force in the rearward direction caused by the compression of the ring gasket 73 within the toroidal volume 72. In this way, a permanent, low-friction connection is established that allows the fitting 25 to rotate freely upon the inner post 61 and maintains the fitting 25 and the inner post 61 in permanent electrical communication.

The outer barrel 60 is constructed of a material or combination of materials having strong, rigid, size- and shape-memory, and electrically-insulative material characteristics, as well as a low coefficient of friction, such as plastic or the like. The alignment mechanism 93, being integrally formed to the outer barrel 60, also has strong, rigid, size- and shape-memory, and electrically-insulative material characteristics, such that compression of the alignment mechanism 93 causes the alignment mechanism 93 to produce a counteracting force in the opposite direction to the compression, tending to return the alignment mechanism 93 back to an original configuration aligned and coaxial to the axis A, so that the fitting 25 is maintained coaxial to the axis A.

With continuing reference to FIG. 3C, the springs 94 and 95 are circumferentially, diameterically offset from each other in the circumferential groove 87. The middles 94*c* and 95*c* are diametrically offset, so as to provide an evenly distributed application of force from opposing sides of the body 22 toward the fitting 25. The acruate and convex shape of the springs 94 and 95 produces a reactive force in response to rearward movement of the fitting 25 when the fitting 25 is threaded onto or coupled to an electrical device, such that the fitting 25 is maintained in a coaxial, aligned state with respect to the axis A, thus maintaining continuity of the connection between the contact faces 101 and 102 completely around the inner post 61. Maintenance of the alignment and the connection ensures that a signal transmitted through the connector 20 is not leaked outside of the connector 20, that outside RF interference does not leak into the connector 20, and that the connector 20 remains electrically grounded. Further, the interaction of the two middles 94*c* and 95*c* with the rear end 32 of the fitting 25 has a low coefficient of friction due to the material construction of those structural features and the limited number of interference sites between the fitting 25 and the alignment mechanism 93. In other embodiments of the alignment mechanism 93, four contact points of the alignment mechanism 93 are evenly spaced to provide an evenly distributed application of force against the fitting 25 at the four contact points.

Referring back to FIG. 3A, the rear end 83 of the outer barrel 60 carries the compression collar 26. The sidewall 150 of the outer barrel 60 with a reduced thickness near the rear end 83 and defines an inner compression band 152. With reference now to the enlarged view of FIG. 3D, the inner compression band 152 includes a major ridge portion 103, a minor ridge portion 104, and a bend 105 formed therebetween. The major and minor ridge portions 103 and 104 have upstanding ridges projecting radially outwardly away from the axis A. The major ridge portion 103 is formed proximate to the rear end 83, the minor ridge portion 104 is formed forward of the major ridge portion 103, and the bend 105 is a flexible thin portion of the sidewall 150 between the major and minor ridge portions 103 and 104, defining a living hinge therebetween. The major ridge portion 103 has an oblique first face 110, which is an interference face, directed toward the rear end 83 of the outer barrel 60, and an oblique second face 111 directed toward the front end 82 of the outer barrel 60. The minor ridge portion 104 has an oblique first face 112, which is an interference face, directed toward the rear end 83 of the outer barrel 60, and an oblique second face 113 directed toward the front end 82 of the outer barrel 60. A V-shaped channel 114 is defined between the second and first faces 111 and 112, respectively. The major and minor ridge portions 103 and 104 are carried on the rear end 83 of the outer barrel 60 by a thin-walled ring 115 opposite the cable-receiving space 90 from the ridges 70*a* and 70*b* on the inner post 61. The thin-walled ring 115 is flexible and deflects radially inwardly toward the axis A in response to a radially-directed application of force. An annular shoulder 116, disposed inboard of the ring 115, has an upstanding abutment surface 120 proximate to the outer surface 85 of the outer barrel 60.

Figure 3D:
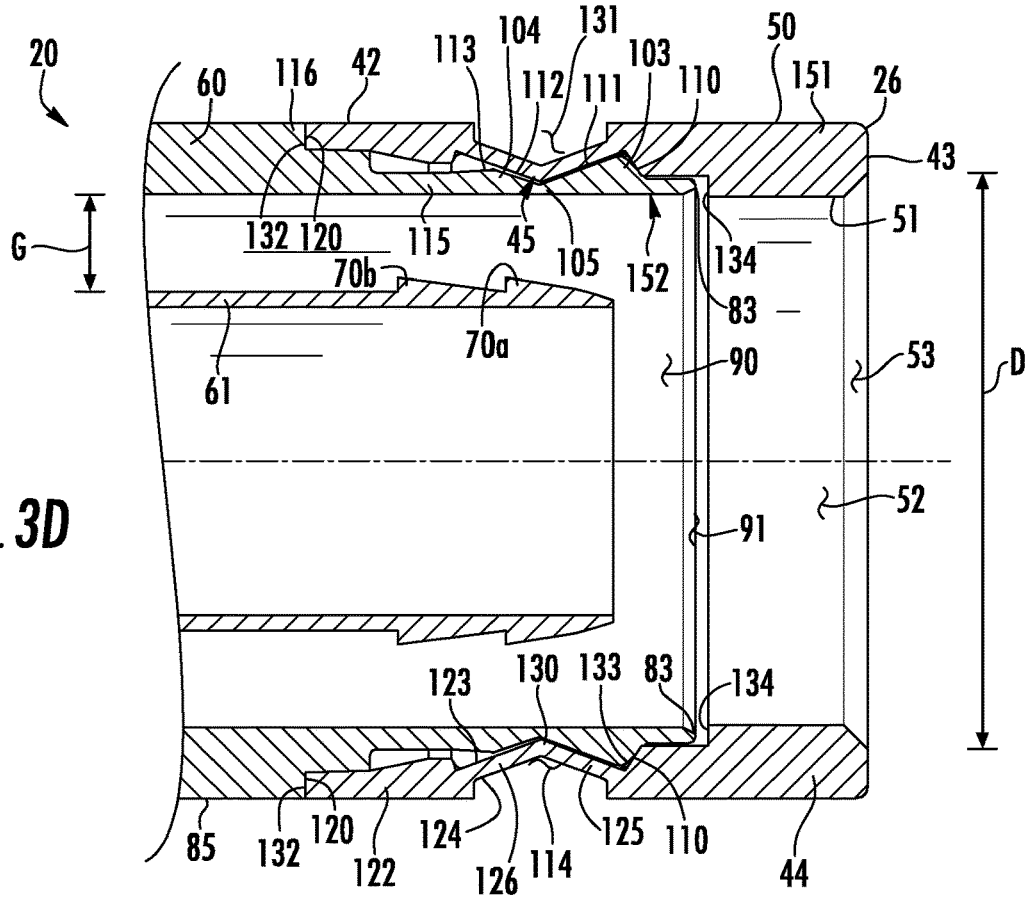

Referring still to FIG. 3D, the sidewall 44 of the compression collar 26 is narrowed at the front end 42 and forms the annular outer compression band 45. The compression collar 26 includes a ring 122 extending forwardly therefrom, an oblique face 133 proximal to the outer compression band 45 disposed between the outer compression band 45 and the inner surface 51, and an annular, upstanding shoulder 134 formed proximate to the rear end 43 and the inner surface 51 of the compression collar 26. The outer compression band 45 is a narrowed, notched portion of the sidewall 44 extending into the interior space 52 and having an inner surface 123 and an opposed outer surface 124, a first wall portion 125, an opposed second wall portion 126, and a flexible bend 130 at which the first and second wall portions 125 and 126 meet. The first and second wall portions 125 and 126 are rigid, and the bend 130 is a living hinge providing flexibility between the first and second wall portions 125 and 126. A compression space 131 is defined between the first and second wall portions 125 and 126 of the outer compression band 45. The ring 122 extends forwardly from the second wall portion 126 and terminates at a terminal edge 132, located in juxtaposition with the abutment surface 120 of the shoulder 116.

With reference still to FIG. 3D, fitted on the outer barrel 60, the compression collar 26 closely encircles the outer barrel 60, with the inner surface 51 of the compression collar 26 in direct contact in a friction-fit engagement with the outer surface 85 of the outer barrel 60 to limit relative radial, axial, and rotational movement. The inner compression band 152 of the outer barrel 60 receives and engages with the outer compression band 45 of the compression collar 26 to limit relative radial, axial, and rotational movement of the compression collar 26, with the shoulder 134 spaced apart from the rear end 83 of the outer barrel 60, the oblique face 133 of the compression collar 26 in juxtaposition with the first face 110 of the major ridge portion 103, the inner surface 123 of the outer compression band 45 along the first wall portion 125 in juxtaposition with the second face 111 of the major ridge portion 103, the bend 130 received in the channel 114 and against the bend 105, the inner surface 123 of the outer compression band 45 along the second wall portion 126 in juxtaposition with the first face 112 of the minor ridge portion 104, and the terminal edge 132 of the compression collar 26 in juxtaposition with the abutment surface 120 of the outer barrel 60, which arrangement defines a fitted condition of the compression collar 26 on the outer barrel 60.

Figure 4A:
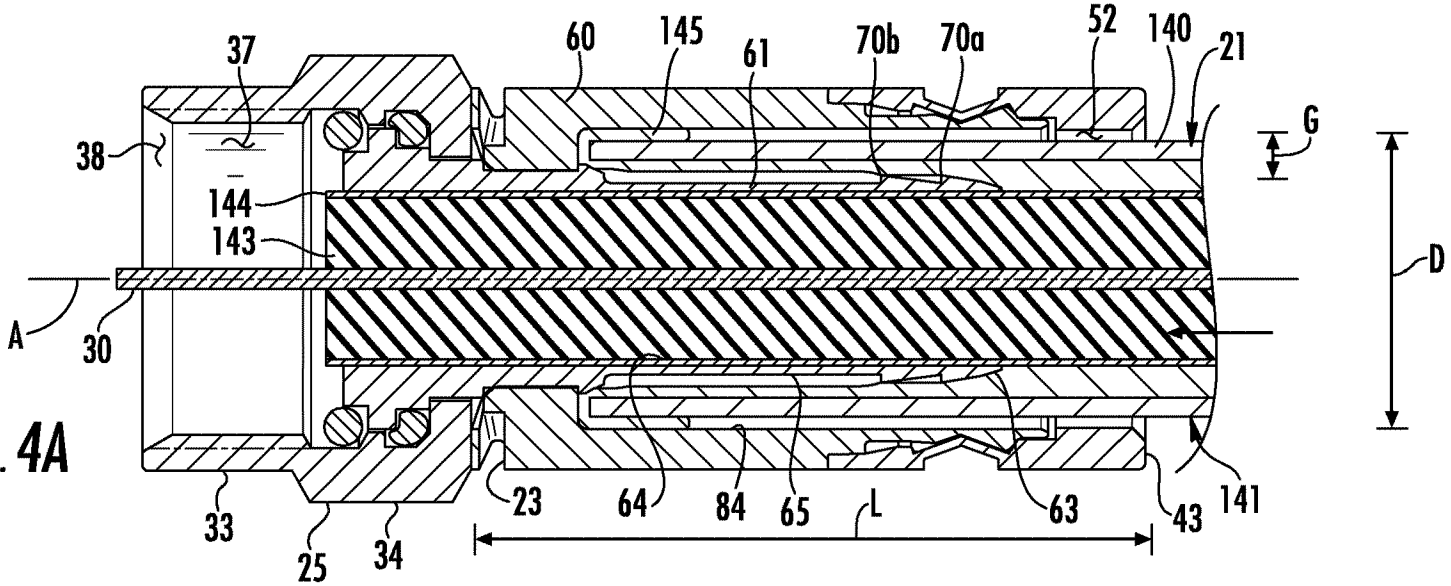
FIGS. 4A and 4B are section views of the coaxial cable connector of FIG. 1 taken along line 3-3 in FIG. 2A in an uncompressed condition and a compressed condition, respectively, applied to the coaxial cable.

In operation, the cable connector 20 is useful for coupling a coaxial cable 21 to an electrical device in electrical communication. To do so, the cable connector is secured to the coaxial cable 21 as shown in FIG. 4A. The coaxial cable 21 is prepared to receive the cable connector 20 by stripping off a portion of a jacket 140 at an end 141 of the coaxial cable 21 to expose an inner conductor 30, a dielectric insulator 143, a foil layer 144, and a flexible shield 145. The dielectric insulator 143 is stripped back to expose a predetermined length of the inner conductor 30, and the end of the shield 145 is turned back to cover a portion of the jacket 140. The end 141 of the coaxial cable 21 is then introduced into the connector 20 to arrange the connector 20 in an uncompressed condition, as shown in FIG. 4A. In this condition, the inner post 61 is disposed between the shield 145 and the foil layer 144 and is in electrical communication with the shield 145.

With reference still to FIG. 4A, to arrange the connector 20 into the uncompressed condition on the coaxial cable 21, the coaxial cable 21 is aligned with the axis A and passed into the interior space 52 of the compression collar 26 along a direction indicated by the arrowed line C. The coaxial cable 21 is then passed through the opening 91 and into the cable-receiving space 90 bound by the inner post 61, ensuring that the inner conductor is aligned with the axis A. The coaxial cable 21 continues to be moved forward along line C in FIG. 4A until the coaxial cable 21 encounters the rear end 63 of the inner post 61, where the shield 145 is advanced over the rear end 63 and the ridges 70*a* and 70*b* are placed in contact with the shield 145, and the portion of the shield 145 turned back over the jacket 140 is in contact with the inner surface 84 of the outer barrel 60. The foil layer 144 and the dielectric insulator 143 are also advanced forward within the inner post 61 against the inner surface 64 of the inner post 61. Further forward movement of the coaxial cable 21 along line C advances the coaxial cable to the position illustrated in FIG. 4A, with the free end of the dielectric insulator 143 disposed within the nut portion 34 of the fitting 25 and the inner conductor 30 extending through the interior space 37 of the ring portion 33 and projecting beyond the opening 38 of the fitting 25. In this arrangement, the shield 145 is in contact in electrical communication with the outer surface 65 of the inner post 61. Further, because the alignment mechanism 93 biases the fitting 25 into permanent electrical communication with the inner post 61, the shield 145 is also in electrical communication with the fitting 25 through the inner post 61, establishing shielding and grounding continuity between the connector 20 and the coaxial cable 21. With reference to FIGS. 3D and 4A, in the uncompressed condition of the connector 20, the outer barrel 60 has an inner diameter D, the inner surface 84 of the outer barrel 60 and the ridges 70*a* and 70*b* are separated by a distance G, and the length of the connector 20 from the front end 23 to the rear end 43 is length L. In embodiments in which the connector 20 is to be used with RG6 style coaxial-cables, the inner diameter D is approximately 8.4 millimeters, the distance G is approximately 1.4 millimeters, and the length L is approximately 19.5 millimeters. Other embodiments, such as would be used with other types of cables, will have different dimensions.

Figure 4B:
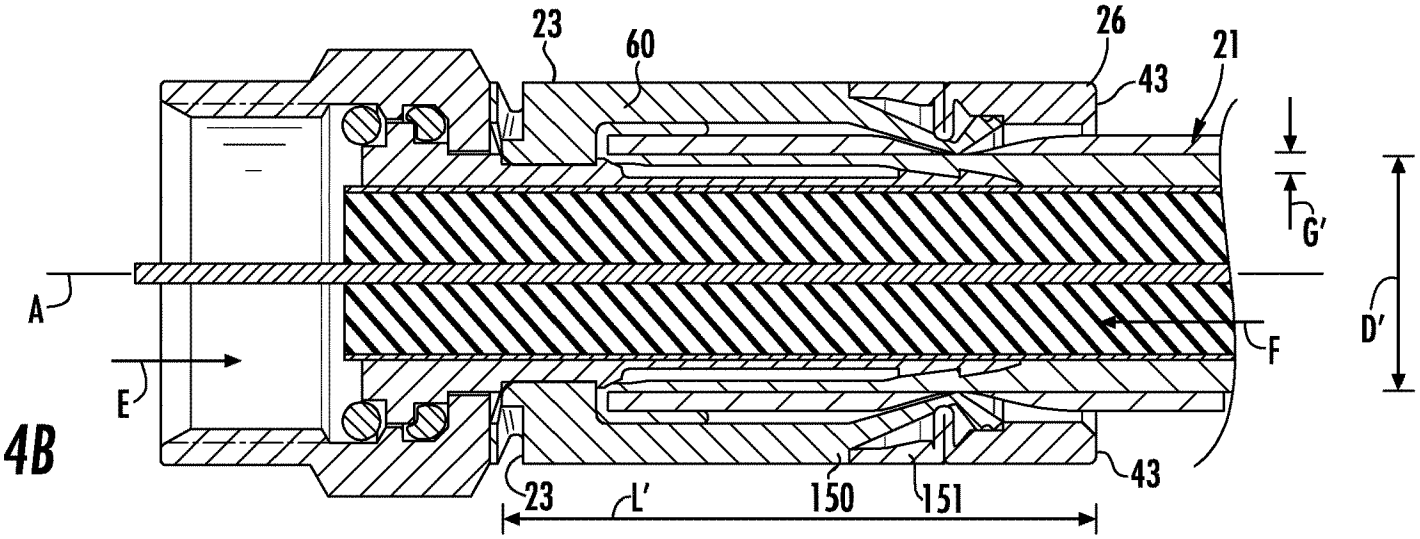

From the uncompressed condition, the connector 20 is moved into the compressed condition illustrated in FIG. 4B. The thin-walled inner and outer compression bands 152 and 45 of the outer barrel 60 and the compression collar 26, are useful for crimping down on the coaxial cable 21 to provide a secure, non-damaging engagement between the connector 20 and the coaxial cable 21. To compress the connector 20, the connector 20 is placed into a compressional tool which grips the connector 20 and compresses the connector 20 axially along the axis A from the front and rear ends 23 and 43 along arrowed lines E and F. The axial compressive forces along lines E and F subject the thinned sidewalls 150 and 44 of the outer barrel 60 and the compression collar 26, respectively, to stress, urging each to deform and bend in response to the stress.

Figure 5:
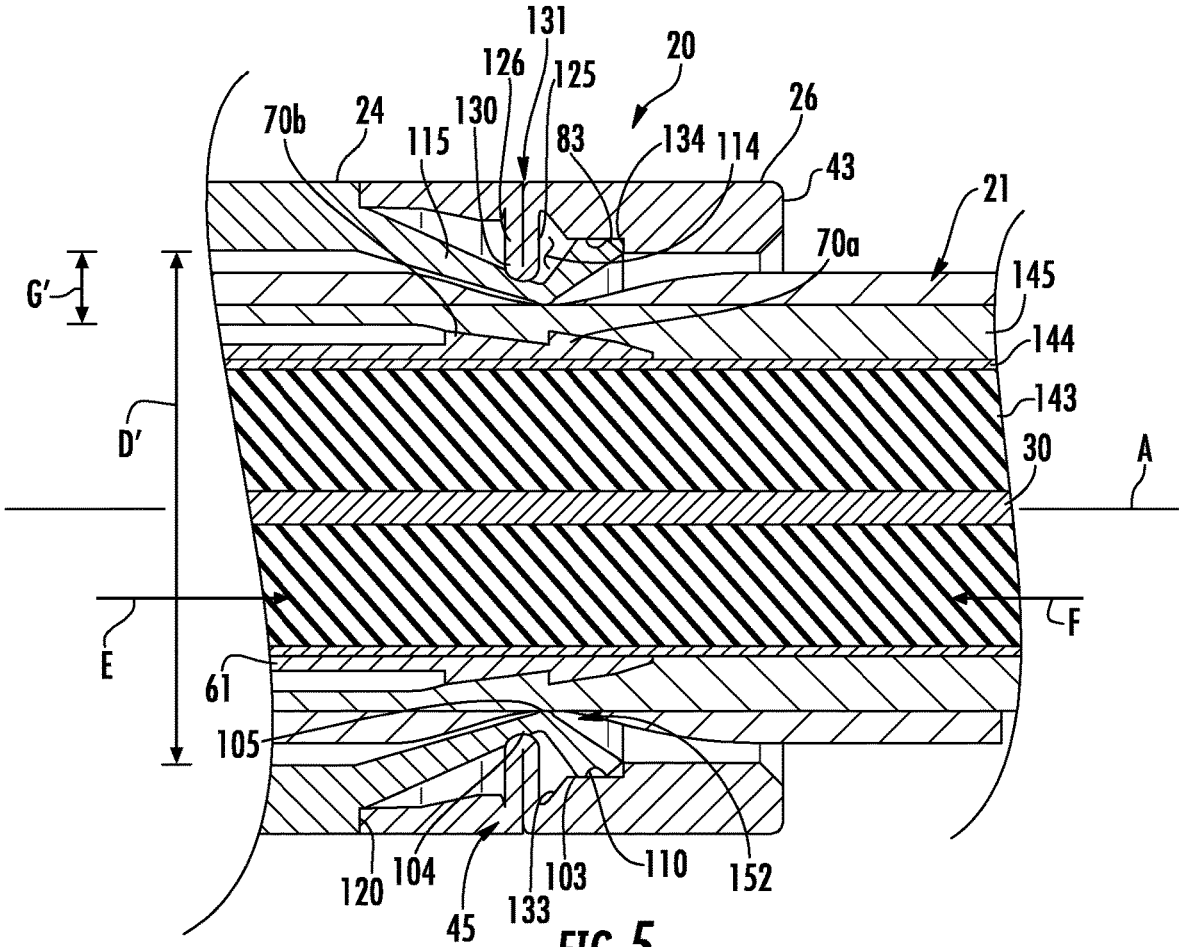
FIG. 5 is an enlarged view of FIG. 4B illustrating the coaxial cable connector of FIG. 1 in a compressed condition applied to the coaxial cable.

FIG. 5 is an enlarged view of the rear end 24 of the body 22 and the compression collar 26, with the coaxial cable 21 applied. As the compression tool operates, in response to the applied axial compressive force, the rear end 43 of the compression collar 26 is advanced toward the outer barrel 60, causing the compression collar 26 and outer barrel 60 to compress at the outer and inner compression bands 45 and 152, respectively. The oblique face 133 of the outer compression band 45 encounters the first face 110 of the major ridge portion 103 of the inner compression band 152 as the abutment surface 120 is advanced toward the compression collar 26. The oblique face 133 and the first face 110 are each oblique to the applied force and are parallel to each other, and the oblique face 133 and the first face 110 slide past each other obliquely to the axis A. The rear end 83 of the outer barrel 60 contacts and bears against the shoulder 134 of the compression collar 26, and as the first face 110 slides over the oblique face 133, the rear end 83 pivots in the shoulder 134, and the ring 115 deforms inwardly, causing the inner compression band 152 to buckle radially inward and the V-shaped channel 114 to deform inwardly. As the V-shaped channel 114 deforms inwardly, the outer compression band 45, under continuing compressive forces, buckles into the V-shaped channel 114. The first and second wall portions 125 and 126 are obliquely oriented inwardly toward the axis A, so that the axial compressive force causes the first and second wall portions 125 and 126 to deform radially inward toward the axis A and come together. The bend 130 is forced radially inward into the V-shaped channel 114 and bears against the bend 105 to deform the inner compression band 152 radially inward. The V-shaped channel 114 catches the buckling outer compression band 45, ensuring that the outer compression band 45 buckles radially, and as the major and minor ridge portions 103 and 104 buckle in response to pivoting and in response to contact with the outer compression band 45, the outer compression band 45 is further carried radially inward toward the ridges 70*a* and 70*b* by the deforming V-shaped channel 114.

Compression continues until the outer compression band 45 is closed such that the compression space 131 is eliminated, and the connector 20 is placed in the compressed condition illustrated in FIGS. 3B, 4B and 5. Although the process of moving the connector 20 from the uncompressed condition to the compressed condition is presented and described above as a series of sequential steps, it should be understood that the compression of the connector 20 on the coaxial cable 21 is preferably accomplished in one smooth, continuous motion, taking less than one second.

In the compressed condition of the connector 20, the inner diameter D of the connector 20 is altered to an inner diameter D', the inner surface of the outer barrel 60 and the barbs 70 are now separated by a distance G', and the length of the body 22 of the connector is now a length L', as indicated in FIG. 4B and FIG. 5. The distance G' is less than half the distance G, the inner diameter D' is approximately the inner diameter D less the distance G', and the length L' is less than the length L. In embodiments in which the connector 20 is to be used with RG6 style coaxial-cables, the inner diameter D' is approximately 6.7 millimeters, the distance G' is approximately 0.5 millimeters, and the length L' is approximately 18.0 millimeters. Other embodiments, such as would be used with other types of cables, will have different dimensions. As seen in FIG. 4B, this significant reduction in diameter causes the jacket 140 and the shield 145 of the coaxial cable 21 to become engaged and crimped between the bend 105 and the ridges 70*a* and 70*b*. Moreover, the bend 105 is opposed from the ridges 70*a* and 70*b* is disposed between the ridges 70*a* and 70*b*, so that the jacket 140 and shield 145 are crimped between the bend 105 and the ridges 70*a* and 70*b* at an axial location between the ridges 70*a* and 70*b*, preventing withdrawal of the coaxial cable 21 from the connector 20. The first and second wall portions 125 and 126 are oriented transversely and generally tangentially to the axis A to support the buckled inner compression band 152 in the buckled arrangement, and to resist withdrawal of the coaxial cable 21 by preventing the outwardly-directed movement of the inner compression band 152.

With continuing reference to FIG. 5, the rigid material characteristics of the inner post 61 prevents the inner post 61 from being damaged by the crimping. Furthermore, because the dielectric insulator 143 and inner conductor 30 are protected within the inner post 61 and the shield 145 is outside the inner post 61 in contact with the outer surface 65, the continuity of the connection between the shield 145 and the inner post 61 is maintained so that a signal transmitted through the connector 20 is not leaked outside of the connector 20, so that outside RF interference does not leak into the connector 20, and so that the connector 20 remains electrically grounded. The interaction between the shield 145 and the ridges 70*a* and 70*b*, which project forwardly and radially outward from axis A, further inhibit movement of the coaxial cable 21 rearward along a direction opposite to line F out of the connector 20, ensuring that the connector 20 is securely applied on the coaxial cable 21.

Figure 6A:
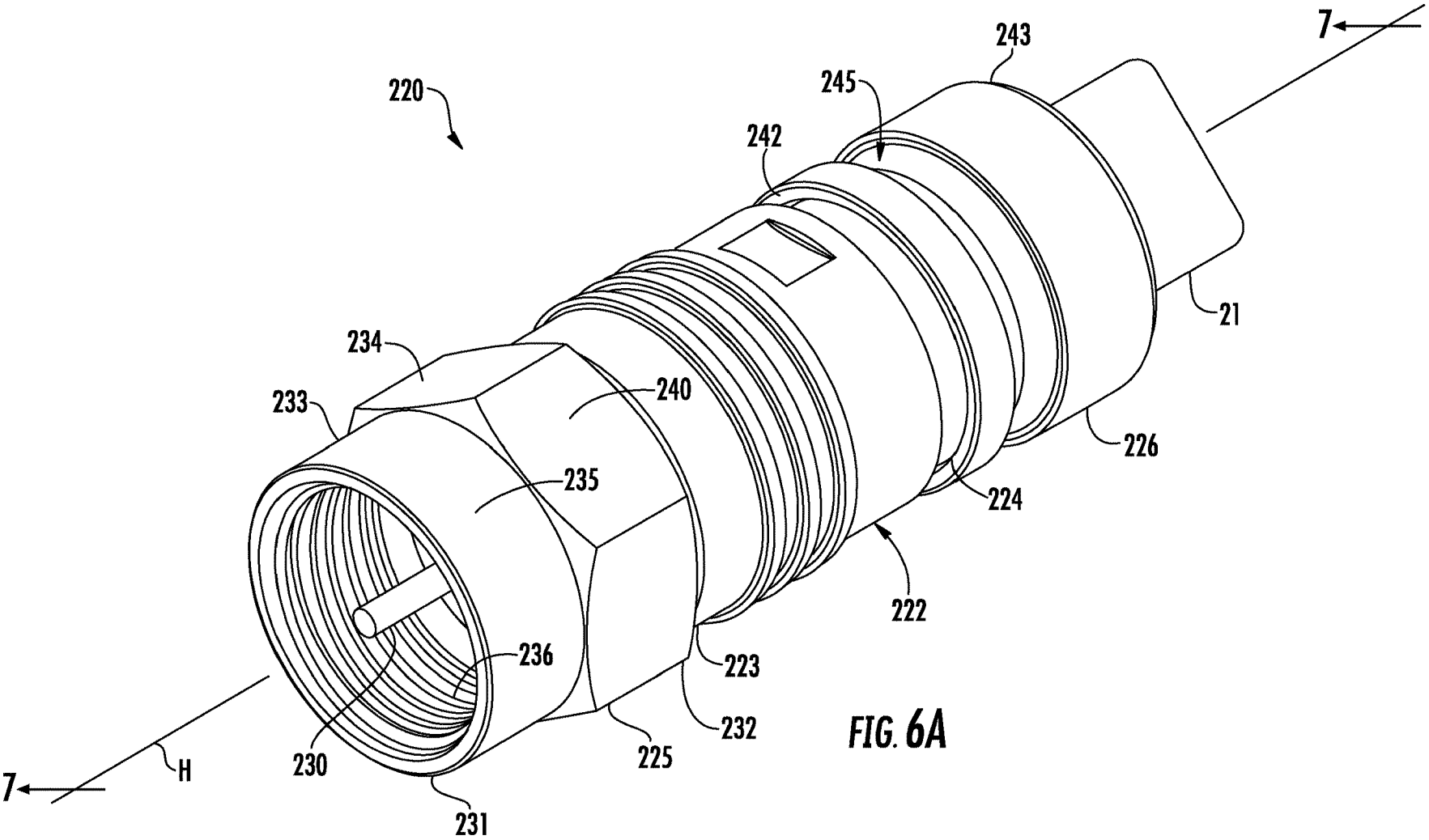
FIGS. 6A and 6B is a perspective view of an embodiment of a coaxial cable connector having a fitting, an outer barrel, and a compression collar, the coaxial cable connector installed in a uncompressed condition and a compressed condition, respectively applied to a coaxial cable.
Figure 6B:
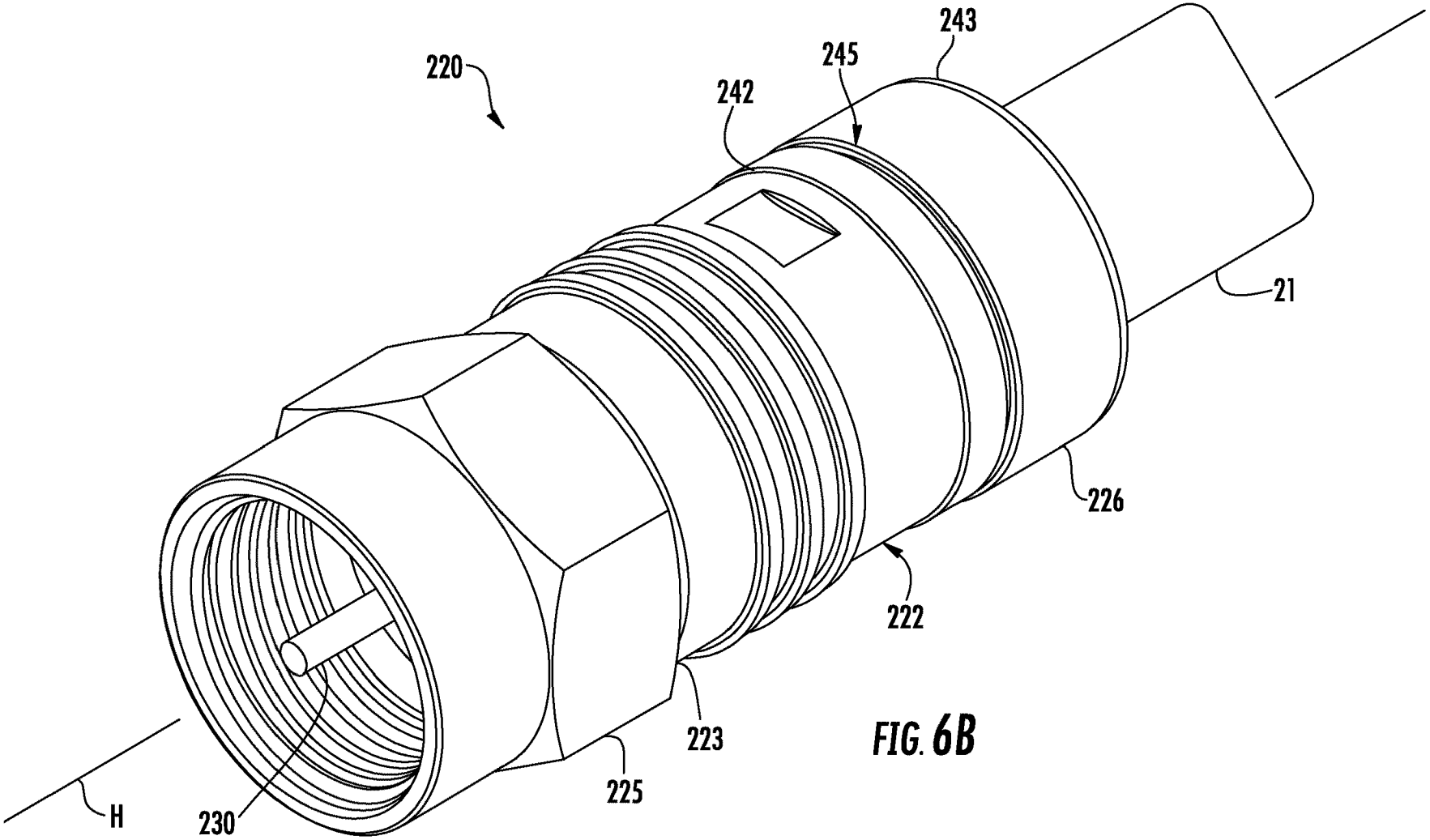

Turning now to FIGS. 6A-8C, an alternate embodiment of a coaxial cable connector 220, constructed and arranged in accordance with the principles of the invention, is shown. FIG. 6A illustrates the connector 220 as it would appear in an uncompressed condition crimped onto a coaxial cable 21. Like the connector 20, the embodiment of the connector 220 shown is an F connector for use with an RG6 coaxial cable for purposes of example, but it should be understood that the description below is also applicable to other types of coaxial cable connectors and other types of cables. The connector 220 includes a body 222 having opposed front and rear ends 223 and 224, a coupling nut or threaded fitting 225 mounted for rotation on the front end 223 of the body 222, and a compression collar 226 mounted to the rear end 224 of the body 222. The connector 220 has rotational symmetry with respect to a longitudinal axis H illustrated in both FIGS. 6A and 6B. The coaxial cable 221 includes an inner conductor 230 and extends into the connector 220 from the rear end 224 in the applied condition of the connector 220. The inner conductor 230 extends through the connector 220 and projects beyond the fitting 225.

Figure 7A:
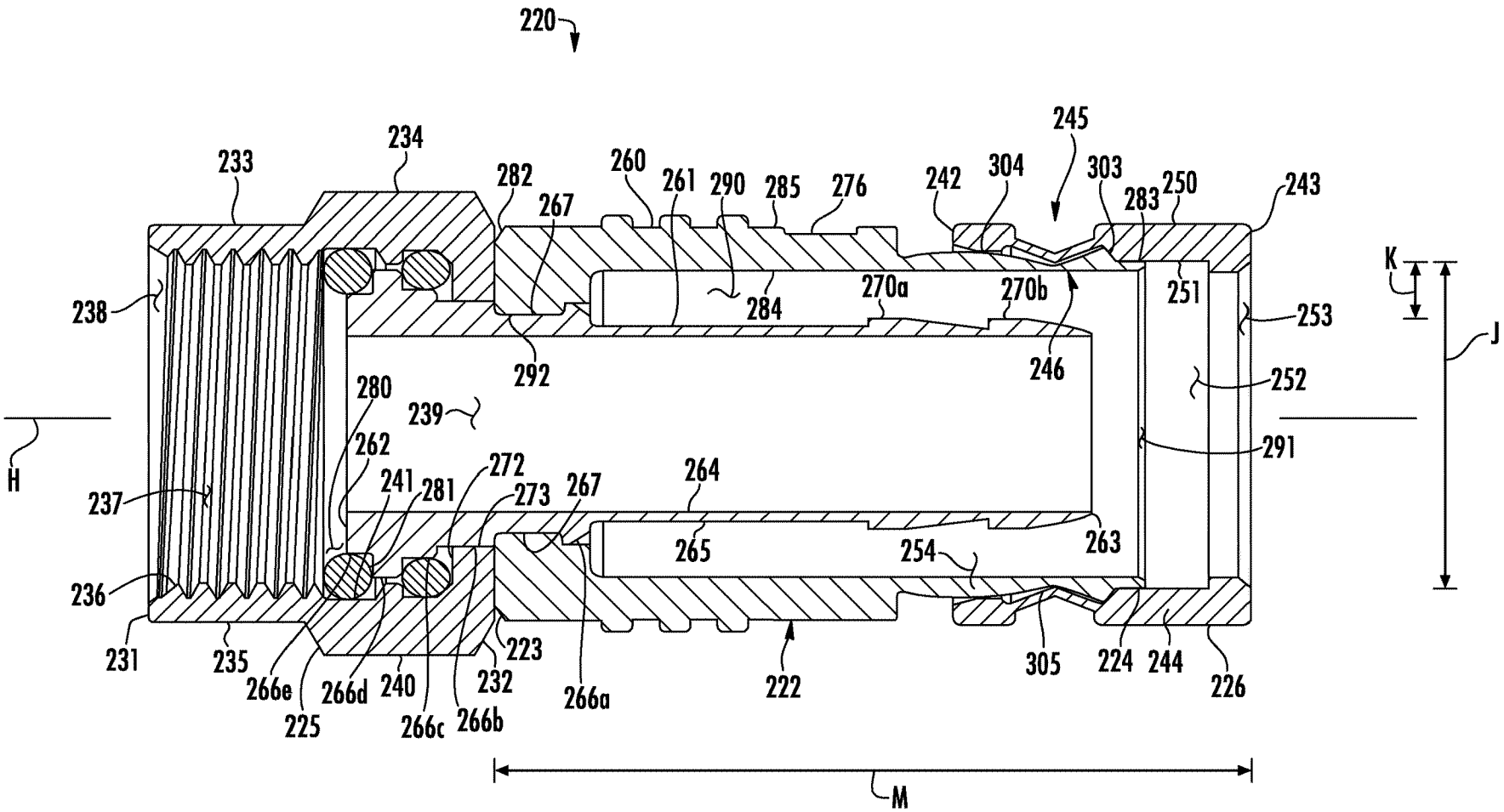
FIG. 7A is a section view of the coaxial cable connector of FIG. 6A taken along the line 7-7 in FIG. 6A.

Referring to FIG. 6A and also to FIG. 7A, which is a section view of the connector 220 taken along the line 7-7 in FIG. 6A but shown without the coaxial cable 221, it can be seen that the fitting 225 is a sleeve having opposed front and rear ends 231 and 232, an integrally-formed ring portion 233 proximate to the front end 231, and an integrally-formed nut portion 234 proximate to the rear end 232. The ring portion 233 has a smooth annular outer surface 235 and an opposed threaded inner surface 236 for engagement with an electrical device. The nut portion 234 of the fitting 225 has a hexagonal outer surface 240 to receive the jaws of a tool and an opposed grooved inner surface 241 (shown in FIG. 7A) to receive gaskets and to engage with the body 222 of the connector 220. Referring now to FIG. 7A, an interior space 237 extends into the fitting 225 from a mouth 238 formed at the front end 231 of the fitting 225, to an opening 239 formed at the rear end 232, and is bound by the inner surfaces 236 and 241 of the ring and nut portions 233 and 234, respectively. Two annular channels 274 and 275 extend outwardly from the interior space 237 into the nut portion 234 from the inner surface 241 continuously around the nut portion 234. The nut portion 234 of the fitting 225 is mounted proximate to the front end 223 of the body 22 for rotation about axis H. The fitting 225 is constructed of a material or combination of materials having strong, hard, rigid, durable, and high electrically-conductive material characteristics, such as metal.

Referring still to FIG. 7A the compression collar 226 has opposed front and rear ends 242 and 243, an annular sidewall 244 extending between the front and rear ends 242 and 243, and an annular outer compression band 245 formed in the sidewall 244 at a location generally intermediate along axis H between the front and rear ends 242 and 243 of the compression collar 226. The compression collar 226 has a smooth annular outer surface 250 and an opposed smooth annular inner surface 251. An interior space 252 bound by the inner surface 251 extends into the compression collar 226 from a mouth 253 formed at the rear end 243 of the compression collar 226 to an opening 254 formed at the front end 242. The interior space 252 is a cylindrical bore and is sized to receive the coaxial cable 221. The compression collar 226 is friction fit onto rear end 224 of the body 222 of the connector 220 proximate to the opening 254 to limit relative radial, axial, and rotational movement of the body 222 and the compression collar 226 about and along axis A, respectively. The compression collar 226 is constructed of a material or combination of materials having strong, hard, rigid, and durable material characteristics, such as metal, plastic, and the like.

The body 222 of the connector 220 is an assembly including a cylindrical outer barrel 260 and a cylindrical, coaxial inner post 261 disposed within the outer barrel 260. The inner post 261 is an elongate sleeve extending along axis H and having rotational symmetry about axis H. The inner post 261 has opposed front and rear ends 262 and 263 and opposed inner and outer surfaces 264 and 265. The outer surface 265 at the rear end 263 of the inner post 261 is formed with two annular ridges 270*a* and 270*b* projecting toward the front end 262 and radially outward from axis H. The ridges 270*a* and 270*b* are spaced apart from each other along the rear end 263 of the inner post 261. The ridges 270*a* and 270*b* provide grip on a coaxial cable applied to the coaxial cable connector 220 and provide an increased diameter over which the coaxial cable must be passed.

Referring still to the view of FIG. 7A, the outer surface 265 of the inner post 261 is formed with a series of outwardly-directed flanges 266*a*, 266*b*, 266*c*, 266*d*, and 266*e* spaced along the inner post 261 proximate to the front end 262. Each flange has a similar structure and projects radially away from the axis H; flanges 266*a* and 266*d* each include a front face directed toward the front end 262 of the inner post 261 and a rear face directed toward the rear end 263 of the inner post 261; flanges 266*b* and 266*c* each include a rear face directed toward the rear end 263 of the inner post 261; and flange 266*e* includes a front face directed toward the front end 262 of the inner post 261. Each of the flanges 266*a*-266*e* extends to a different radial distance away from the axis H. Flanges 266*a* and 266*b* form an annular dado or channel 267 around the inner post 261 defined between the front face of the flange 266*a* and the rear face of the flange 266*b*. The outer barrel 260 is coupled to the inner post 261 at the channel 267.

Referring still to FIG. 7A, the rear end 232 of the fitting 225 cooperates with the inner surface 241 of the nut portion 234 at the channel 274, the outer surface 265 of the inner post 261 at the flange 266*c*, and the rear face of the flange 266*d* to form a first toroidal volume 272 between the inner post 261 and the nut portion 234 for receiving a ring gasket 273. Additionally, the inner surface 241 of the nut portion 234 at the channel 275 cooperates with the front face of the flange 266*d* and the outer surface 265 of the inner post 261 at the flange 266*e* to form a second toroidal volume 280 between the inner post 261 and the nut portion 234 for receiving a ring gasket 281. The fitting 225 is supported and carried on the inner post 261 by the ring gaskets 273 and 281, and the ring gaskets 273 and 281 prevent the introduction of moisture into the connector 220. The inner post 261 is constructed of a material or combination of materials having hard, rigid, durable, and high electrically-conductive material characteristics, such as metal, and the ring gaskets 273 and 281 are constructed from a material or combination of materials having deformable, resilient, shape-memory material characteristics.

The outer barrel 260 is an elongate, cylindrical sleeve extending along axis H with rotational symmetry about axis H, and is constructed of a material or combination of materials having strong, rigid, size- and shape-memory, and electrically-insulative material characteristics, as well as a low coefficient of friction, such as plastic or the like. The outer barrel 260 has a sidewall 276 with opposed front and rear ends 282 and 283 and opposed inner and outer surfaces 284 and 285. The inner surface 284 defines and bounds an interior cable-receiving space 290 shaped and sized to receive the coaxial cable 221, and in which the rear end 263 of the inner post 261 is disposed. An opening 291 at the rear end 283 of the outer barrel 260 communicates with the interior space 252 of the compression collar 226 and leads into the interior cable-receiving space 290. The front end 282 of the outer barrel 260 is formed with an radially-inward projecting annular lip 292. The lip 292 abuts and is received in the channel 271 in a friction-fit engagement, securing the outer barrel 260 on the inner post 261.

With continuing reference to FIG. 7A the fitting 225 is mounted for free rotation on the inner post 261 about the axis H. To allow free rotation, the ring gaskets 273 and 281 space the nut portion 225 just off the inner post 261 in a radial direction, creating an annular gap between the inner post 261 and the nut portion 225 which allows for slight movement in the radial direction, and allows the fitting 225 to rotate with low rolling friction on the ring gaskets 273 and 281. In this way, a permanent, low-friction connection is established that allows the fitting 225 to rotate freely upon the inner post 261 while still maintaining the fitting 225 and the inner post 261 in permanent electrical communication.

Figure 7B:
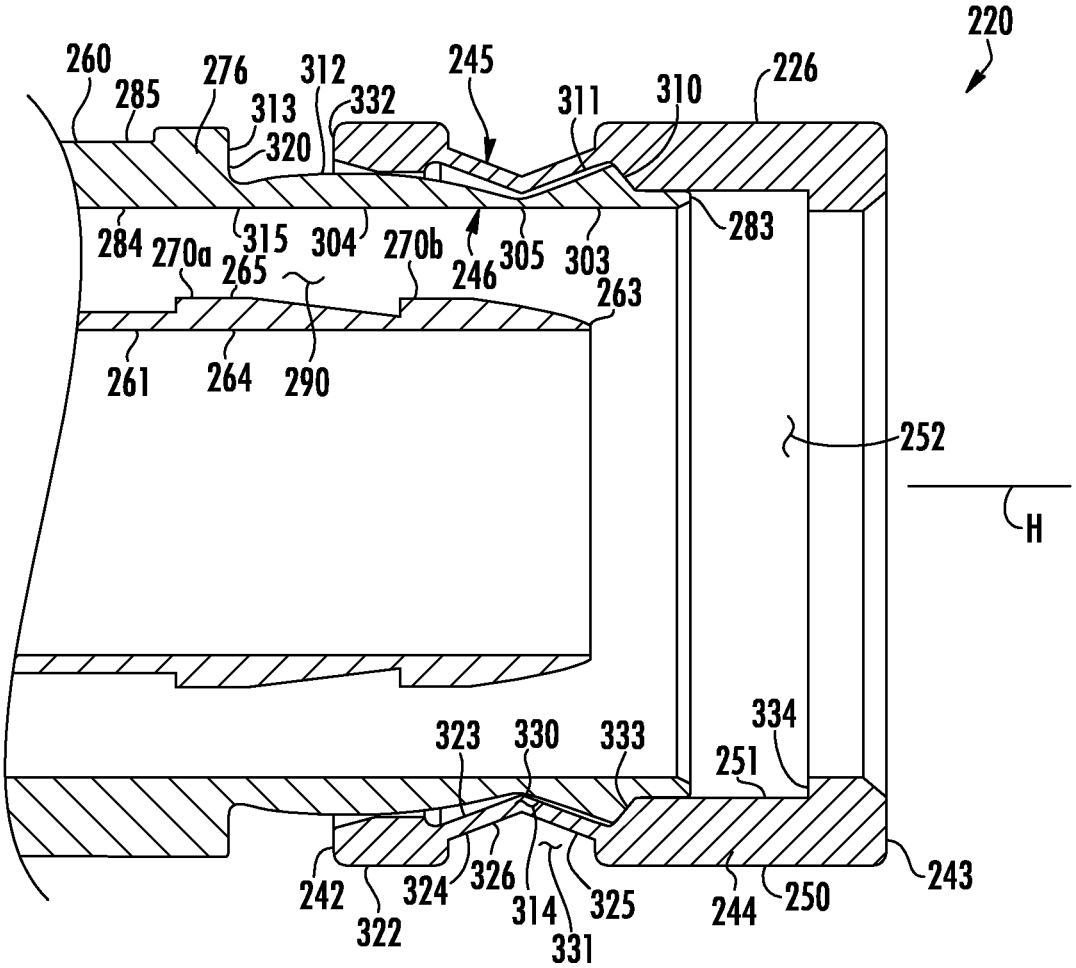
FIG. 7B is an enlarged section view of the coaxial cable connector of FIG. 6A taken along the line 7-7 in FIG. 6A showing the compression collar in detail.

Turning now to the enlarged view of FIG. 7B, the rear end 283 of the outer barrel 260 carries the compression collar 226. The sidewall 276 of the outer barrel 260 with a reduced thickness near the rear end 283 and defines an inner compression band 246. The inner compression band 246 includes a ridge portion 303, a rounded hump portion 304, and a bend 305 formed therebetween. The ridge and rounded portions 303 and 304 project radially outward away from the axis H. The ridge portion 303 is formed proximate to the rear end 283, the rounded hump portion 304 is formed forward of the ridge portion 303, and the bend 305 is a flexible thin portion of the sidewall 276 between the ridge and rounded portions 303 and 304, defining a living hinge therebetween. The ridge portion 303 has an oblique first face 310, which is an interference face, directed toward the rear end 283 of the outer barrel 260, and an oblique second face 311 directed toward the front end 282 of the outer barrel 260. The rounded hump portion 304 has a convex face 312 extending between the bend 305 and an annular shoulder 313. A V-shaped channel 314 is defined between the second face 311 of the ridge portion 303 and the convex face 312 of the rounded hump portion 304. The ridge portion 303 is carried on the rear end 283 of the outer barrel 260 by a thin-walled ring 315 at the base of the shoulder 313, opposite the cable-receiving space 290 from the ridges 270*a* and 270*b* on the inner post 261. The thin-walled ring 315 is flexible and deflects radially inwardly toward the axis H in response to a radially-directed application of force. The annular shoulder 316 has an upstanding abutment surface 320 proximate to the outer surface 285 of the outer barrel 260.

Referring still to FIG. 7B, the sidewall 244 of the compression collar 226 is narrowed proximate to the front end 242 and forms the annular outer compression band 245. The compression collar 226 includes a ring 322 extending forwardly therefrom, an oblique face 333 proximal to the outer compression band 245 disposed between the outer compression band 245 and the inner surface 251, and an annular, upstanding shoulder 334 formed proximate to the rear end 243 and the inner surface 251 of the compression collar 226. The outer compression band 245 is a narrowed, notched portion of the sidewall 244 extending into the interior space 252 and having an inner surface 323 and an opposed outer surface 324, a first wall portion 325, an opposed second wall portion 226, and a flexible bend 330 at which the first and second wall portions 325 and 326 meet. The first and second wall portions 325 and 326 are rigid, and the bend 330 is a living hinge providing flexibility between the first and second wall portions 325 and 326. A compression space 331 is defined between the first and second wall portions 325 and 326 of the outer compression band 245. The ring 322 extends forwardly from the second wall portion 326 and terminates at a terminal edge 332 at the front end 242, spaced apart longitudinally from the shoulder 313 of the outer barrel 260.

With reference still to FIG. 7, fit over the rear end 283 of the outer barrel 260, the compression collar 226 closely encircles the outer barrel 260, with the inner surface 251 of the compression collar 226 in direct contact in a friction-fit engagement with the outer surface 285 of the outer barrel 260 to limit relative radial, axial, and rotational movement. The inner compression band 246 of the outer barrel 260 receives and engages with the outer compression band 245 of the compression collar 226 to limit relative radial, axial, and rotational movement of the compression collar 226, with the shoulder 334 spaced apart from the rear end 283 of the outer barrel 260, the oblique face 333 of the compression collar 226 in juxtaposition with the first face 310 of the major ridge portion 303, the inner surface 323 of the outer compression band 245 along the first wall portion 325 in juxtaposition with the second face 311 of the ridge portion 303, the bend 330 received in the channel 314 and against the bend 305, the inner surface 323 of the outer compression band 245 along the second wall portion 326 spaced radially apart from the convex face 312 of the rounded hump portion 304, and the terminal edge 332 of the compression collar 226 spaced longitudinally apart from the abutment surface 320 on the shoulder 313 of the outer barrel 260, which arrangement defines a fitted condition of the compression collar 226 on the outer barrel 260.

Figure 8A:
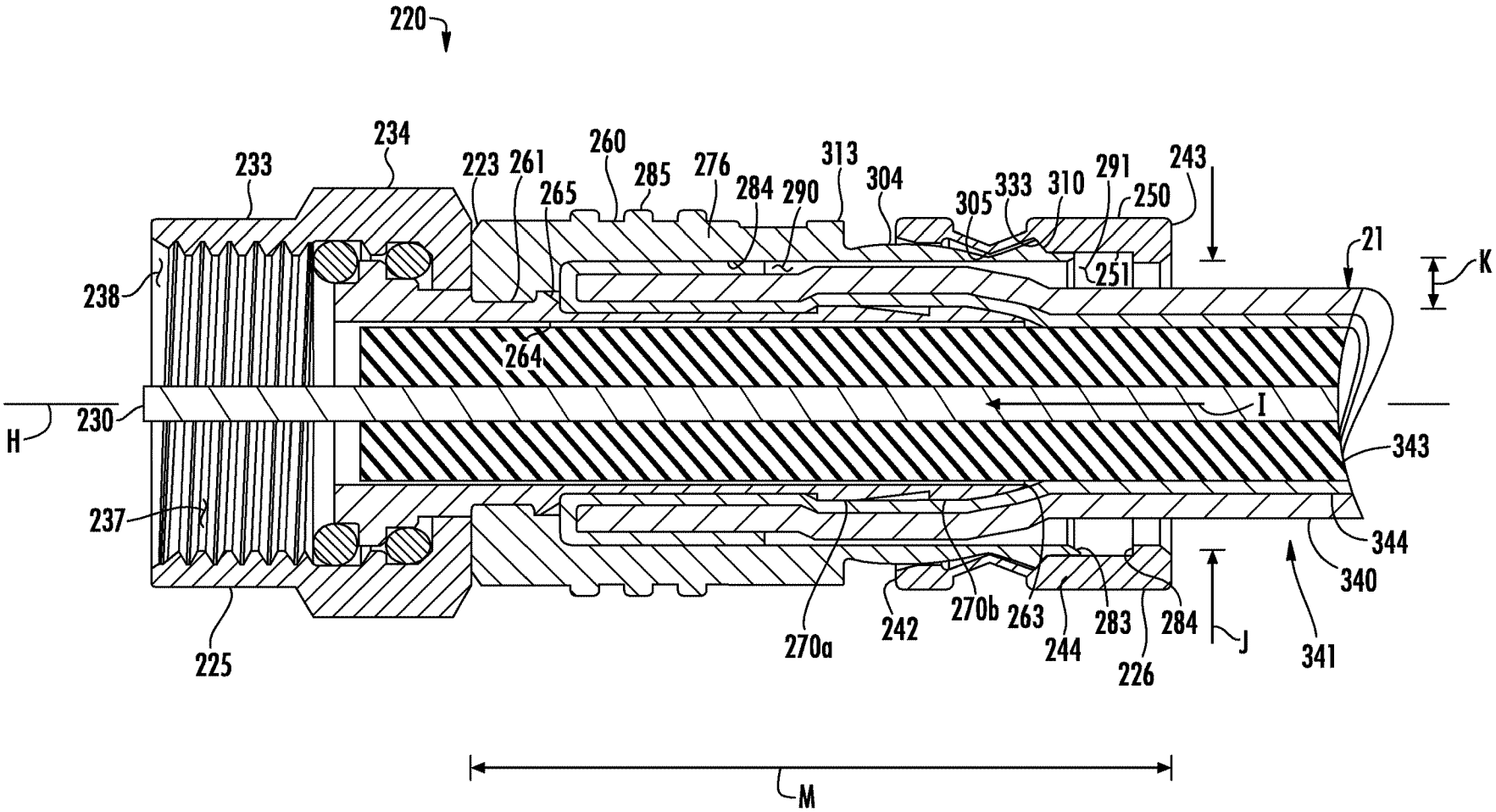
FIGS. 8A-8C are section views taken along the line 7-7 in FIG. 6A, showing a sequence of steps of applying the coaxial cable to the coaxial cable connector.
Figure 8B:
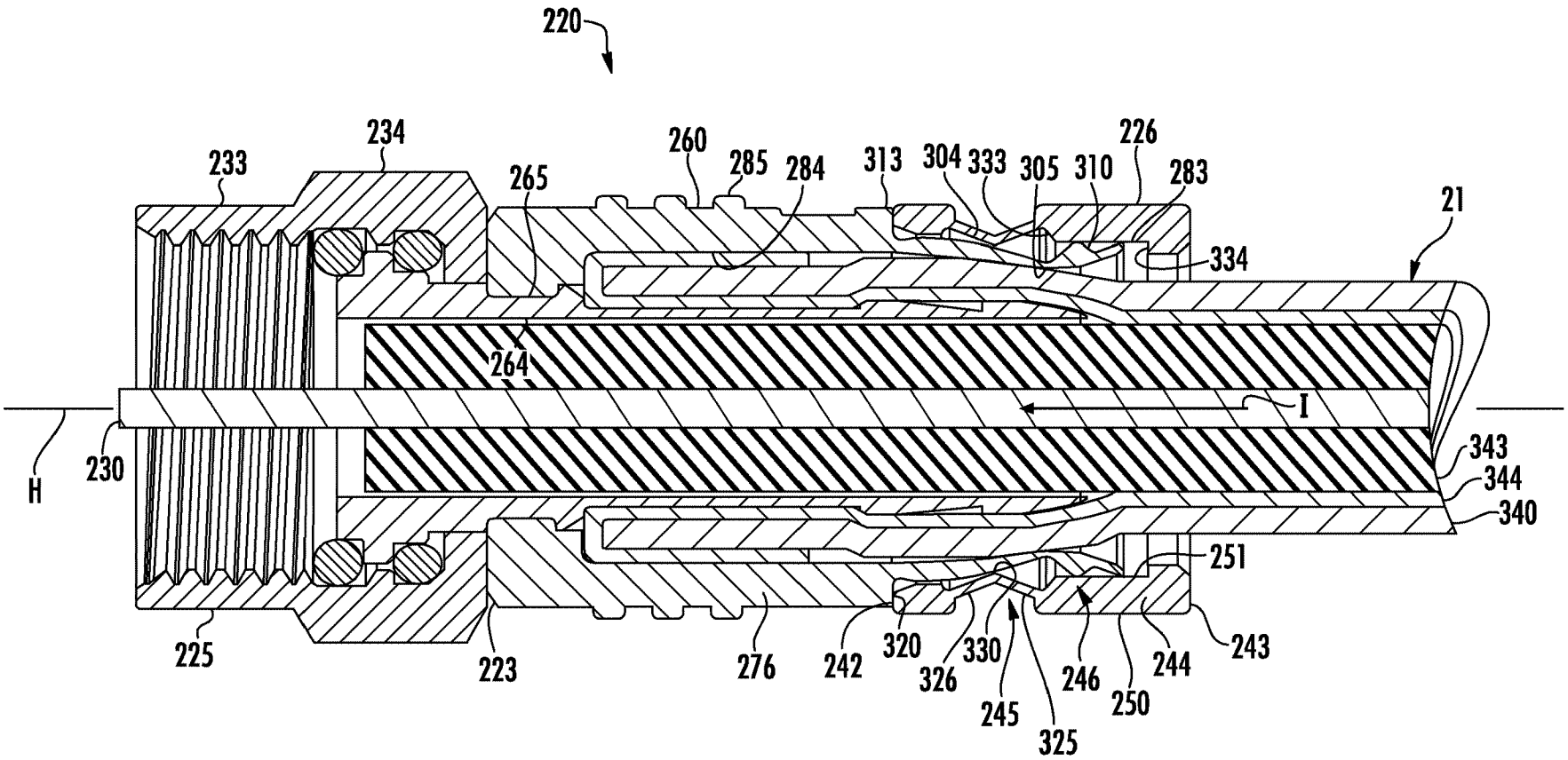
Figure 8C:
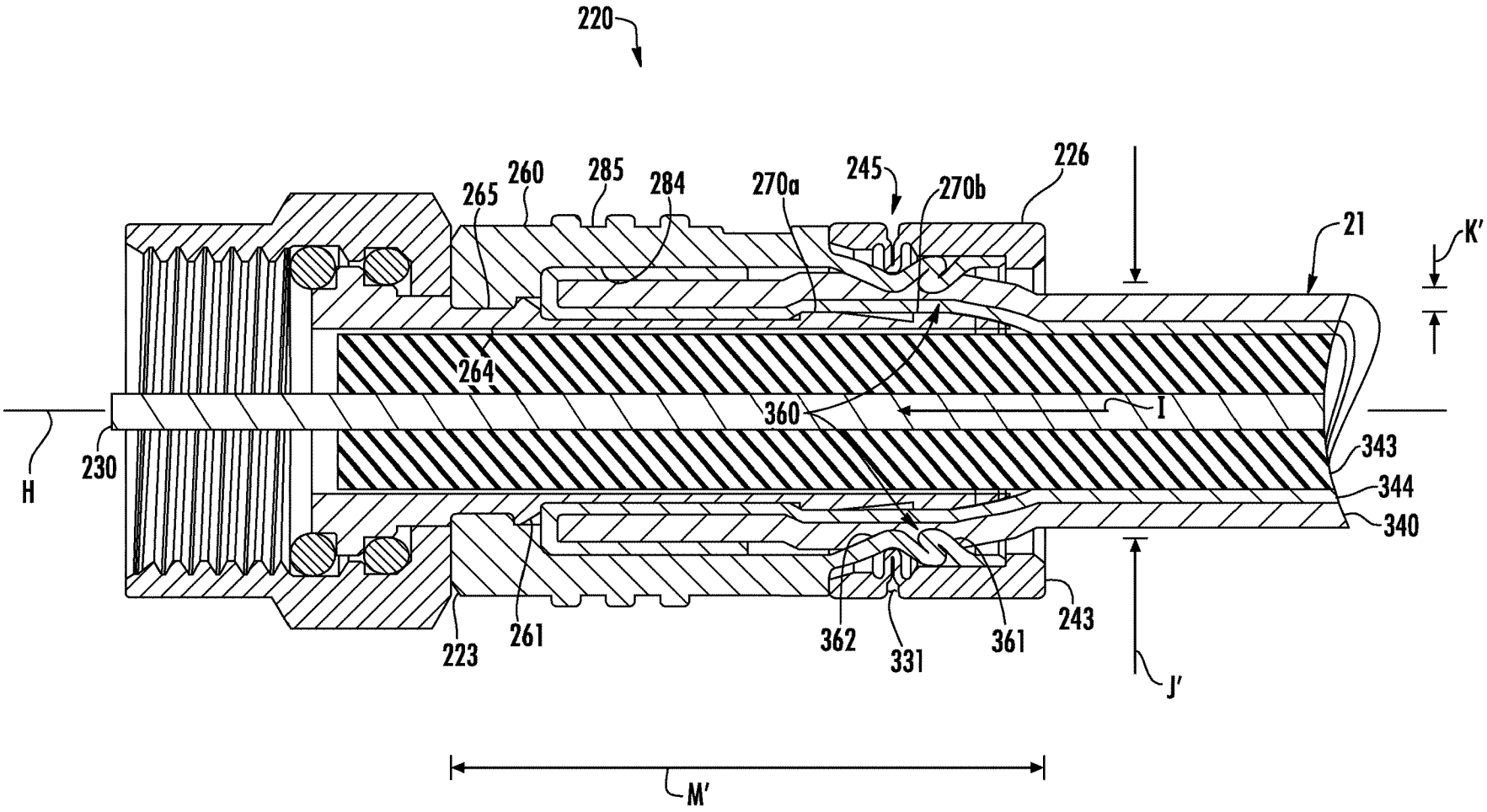

In operation, the cable connector 20 is useful for coupling a coaxial cable 21 to an electrical device in electrical communication, which is accomplished through a series of steps shown in FIGS. 8A-8C. Initially, the cable connector 220 is secured to the coaxial cable 21 as shown in FIG. 8A. The coaxial cable 21 is prepared to receive the cable connector 220 by stripping off a portion of a jacket 340 at an end 341 of the coaxial cable 21 to expose the inner conductor 230, a dielectric insulator 343, and a flexible shield 344. The dielectric insulator 343 is stripped back to expose a predetermined length of the inner conductor 230, and the end of the shield 344 is turned back to cover a portion of the jacket 340. The end 341 of the coaxial cable 21 is then introduced into the connector 220 to arrange the connector 220 in an uncompressed condition, as shown in FIG. 8A. In this condition, the inner post 261 is disposed between the shield 344 in electrical communication with the shield 344.

With reference still to FIG. 8A, to arrange the connector 220 into the uncompressed condition on the coaxial cable 21, the coaxial cable 21 is aligned with the axis H and passed into the interior space 252 of the compression collar 226 along a direction indicated by the arrowed line I. The coaxial cable 21 is then passed through the opening 291 and into the cable-receiving space 290 bound by the inner post 261, ensuring that the inner conductor is aligned with the axis H. The coaxial cable 21 continues to be moved forward along line I in FIG. 8A until the coaxial cable 21 encounters the rear end 263 of the inner post 261, where the shield 344 is advanced over the rear end 263 and the ridges 270*a* and 270*b* are placed in contact with the shield 344, and the portion of the shield 344 turned back over the jacket 340 is in contact with the inner surface 284 of the outer barrel 260. The dielectric insulator 343 is also advanced forward within the inner post 261 against the inner surface 264 of the inner post 261. Further forward movement of the coaxial cable 21 along line I advances the coaxial cable to the position illustrated in FIG. 8A, with the free end of the dielectric insulator 343 disposed within the nut portion 234 of the fitting 225 and the inner conductor 230 extending through the interior space 237 of the ring portion 233 and projecting beyond the opening 238 of the fitting 225. In this arrangement, the shield 344 is in contact in electrical communication with the outer surface 265 of the inner post 261.

With reference to FIGS. 7A and 8A, in the uncompressed condition of the connector 20, the outer barrel 60 has an inner diameter J, the inner surface 284 of the outer barrel 260 and the ridges 270*a* and 270*b* are separated by a distance K, and the length of the connector 220 between the front end 223 of the outer barrel 260 to the rear end 243 of the compression collar 226 is length M. In embodiments in which the connector 220 is to be used with RG6 style coaxial-cables, the inner diameter J is approximately 8.4 millimeters, the distance K is approximately 1.4 millimeters, and the length M is approximately 19.5 millimeters. Other embodiments, such as would be used with other types of cables, will have different dimensions.

From the uncompressed condition, the connector 220 is moved toward the compression condition illustrated in FIG. 8C by axially compressing the connector 220. The thin-walled outer and inner compression bands 245 and 246 of the outer barrel 260 and the compression collar 226, are useful for crimping down on the coaxial cable 21 to provide a secure, non-damaging engagement between the connector 220 and the coaxial cable 21 which prevents the cable 21 from being retracted from the connector 220. To compress the connector 220, the connector 220 is placed into a compressional tool which grips the connector 220 and compresses the connector 220 axially along the axis H from the front and rear ends 223 and 243.

The axial compressive forces along the axis H causes the compression collar 226 to move forward along the outer barrel 260 in the direction indicated by line I in FIG. 8B. The oblique first face 310 of the inner compression band 246 encounters the oblique face 333 of the outer compression band 245 and is diverted radially inwardly, causing the rear end 283 of the outer barrel 260 to collapse and deform radially inwardly. The first face 310 slides against the inner surface 251 of the compression collar 226, and the bend 305 deforms radially inwardly into the jacket 340, which causes the rounded hump portion 304 to deform inwardly as well. The bend 330 of the outer compression band 245 slides in contact with the rounded hump portion 304 as the compression collar 226 moves forward along the outer barrel 260.

The compression collar 226 stops advancing forward when the front end 242 reaches the shoulder 313 and contacts the abutment face 320. The abutment face 320 prevents further movement of the compression collar 226 along the outer barrel 260, but while the axial compression continues, the compression collar 226 compresses. The axial compressive forces along the axis H subject the thinned sidewalls 276 and 244 of the outer barrel 260 and the compression collar 226, respectively, to stress, urging each to deform and bend in response to the stress. The rear end 243 of the compression collar 326 is advanced toward the outer barrel 260, causing the compression collar 226 and outer barrel 260 to compress at the outer and inner compression bands 245 and 246, respectively.

The outer compression band 245, under continuing axial compressive forces, buckles into the V-shaped channel 314. The first and second wall portions 325 and 326 are obliquely oriented inwardly toward the axis H, so that the axial compressive force causes the first and second wall portions 325 and 326 to deform radially inward toward the axis H and come together. The bend 330 is forced radially inward into the rounded hump portion 304 to deform the inner compression band 246 radially inward as well. As the compression collar 226 compresses axially, the rear end 283 of the outer barrel 260 encounters the internal shoulder 334 at the rear end 243 of the compression collar 226 and is caught and held there. Continued compression, cooperating with the inward buckling of the outer compression band 245, causes the inner compression band 246 to buckle as well, as seen in FIG. 3B. The rear end 283 of the outer barrel 260 contacts and bears against the shoulder 334 of the compression collar 226, and the rear end 283 pivots inwardly at the shoulder 334, causing this buckling of the inner compression band 46 against the rounded hump portion 304.

Compression continues, and movement of the outer compression band 246 into the compressed condition thereof shapes the inner compression band 246 into a pawl 360, as shown in FIG. 3C. The pawl 360 is continuously annular and formed into the interior of the cable connector 220. The pawl 360 includes an annular folded lip 361 directed toward the front end of the outer barrel, and annular V-shaped channel 362 directed radially inward toward the axis H. The lip 361 overlies the channel 362. The outer compression band 245 is closed such that the compression space 331 is eliminated, and the connector 220 is placed in the compressed condition. Although the process of moving the connector 220 from the uncompressed condition to the compressed condition is presented and described above as a series of sequential steps, it should be understood that the compression of the connector 220 on the coaxial cable 21 is preferably accomplished in one smooth, continuous motion, taking less than one second.

In the compressed condition of the connector 220, the inner diameter J of the connector 220 is altered to an inner diameter J', the inner surface 284 of the outer barrel 260 and the barbs 270*a* and 270*b* are now separated by a distance K', and the length of the connector 220 between the front end 223 of the outer barrel 260 to the rear end 243 of the compression collar 226 is length M'. The distance K' is less than half the original distance K, the inner diameter J' is approximately the original inner diameter J less the distance K', and the length M' is less than the original length M. In embodiments in which the connector 220 is to be used with RG6 style coaxial-cables, the inner diameter J' is approximately 6.7 millimeters, the distance K' is approximately 0.5 millimeters, and the length M' is approximately 18.0 millimeters. Other embodiments, such as would be used with other types of cables, will have different dimensions. As seen in FIG. 8C, this significant reduction in diameter causes the jacket 340 and the shield 344 of the coaxial cable 21 to become engaged and crimped between the pawl 360 and the ridges 270*a* and 270*b* of the inner post 261.

Moreover, the pawl 360 is opposed from the ridges 270*a* and 270*b*, the channel 362 is disposed between the ridges 270*a* and 270*b*, and the lip 361 is behind the ridge 270*b*, toward the rear end 243 of the outer barrel 260, so that the jacket 340 and shield 344 are crimped between the pawl 360 and the ridges 270*a* and 270*b* at an axial location between the ridges 270*a* and 270*b*, preventing withdrawal of the coaxial cable 21 from the connector 220. The pawl 360 allows movement of the cable 21 into the connector 220 along the direction indicated by arrowed line I in FIG. 8C, but prevents withdrawal of the cable 21 along a direction opposite to that of line I. When the cable 21 is attempted to be withdrawn, the pawl 360 deforms radially inwardly and further binds on the jacket 340, and the jacket 340 and shield 344 are compressively gripped between pawl 360 and the barbs 270*a* and 270*b*.

With continuing reference to FIG. 8C, the rigid material characteristics of the inner post 261 prevents the inner post 261 from being damaged by the crimping during application of the connector 220 on the cable 21. Furthermore, because the dielectric insulator 343 and inner conductor 230 are protected within the inner post 261 and the shield 344 is outside the inner post 261 in contact with the outer surface 265 of the inner post 261, the continuity of the connection between the shield 344 and the inner post 261 is maintained so that a signal transmitted through the connector 220 is not leaked outside of the connector 220, so that outside RF interference does not leak into the connector 220, and so that the connector 220 remains electrically grounded. The interaction between the shield 344 and the ridges 270*a* and 270*b*, which project forwardly and radially outward from axis H, further inhibit movement of the coaxial cable 21 rearwardly along a direction opposite to line I out of the connector 220, ensuring that the connector 220 is securely applied on the coaxial cable 21.

With the connector 220 in the compressed condition, the connector 220 can now be coupled to an electrical device in a common and well-known manner by threading the connector 220 onto a threaded post of a selected electrical device.

Figure 9:
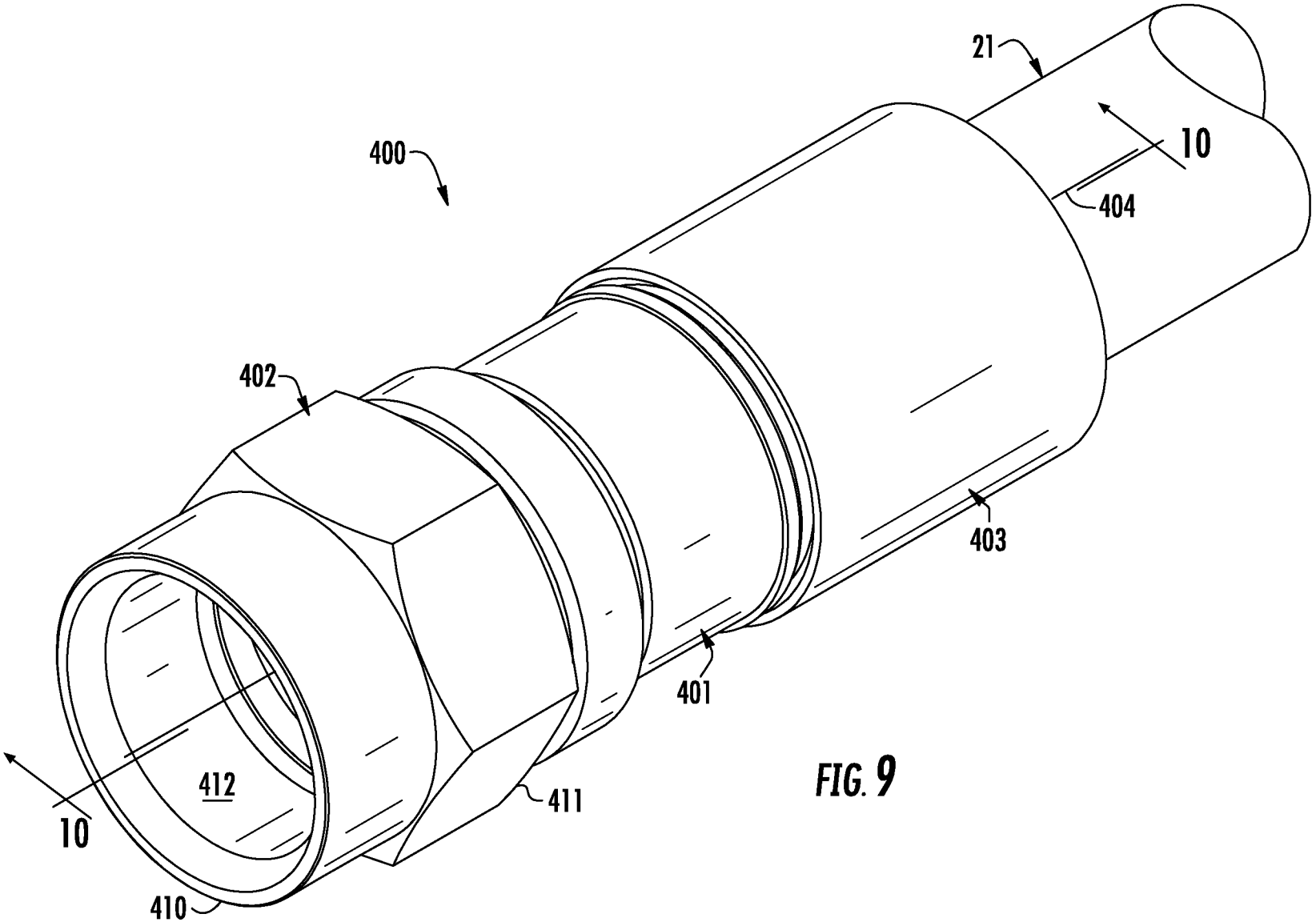
FIG. 9 is a perspective view of an embodiment of a coaxial cable connector having a fitting, an outer barrel, and a compression collar, the coaxial cable connector applied to a coaxial cable.

Turning now to FIGS. 9-11C, an alternate embodiment of a coaxial cable connector 400 is shown. FIG. 9 illustrates the connector 400 in perspective as it would appear applied to a coaxial cable 21. The connector 400 is an F Connector for use with an RG6 coaxial cable for exemplary purposes, but it should be understood that the description below is also applicable to other types of coaxial cables. The connector 400 includes a barrel 401, a coupling nut or fitting 402 mounted for rotation on the barrel 401, and a compression collar 403 mounted to the barrel 401 for axial movement between retracted and advanced positions with respect to the barrel 401. The connector 400 has rotational symmetry with respect to a longitudinal axis 404. As shown in FIG. 10A, the barrel 401 and the fitting 402 are mounted on an inner post 405.

Figure 10A:
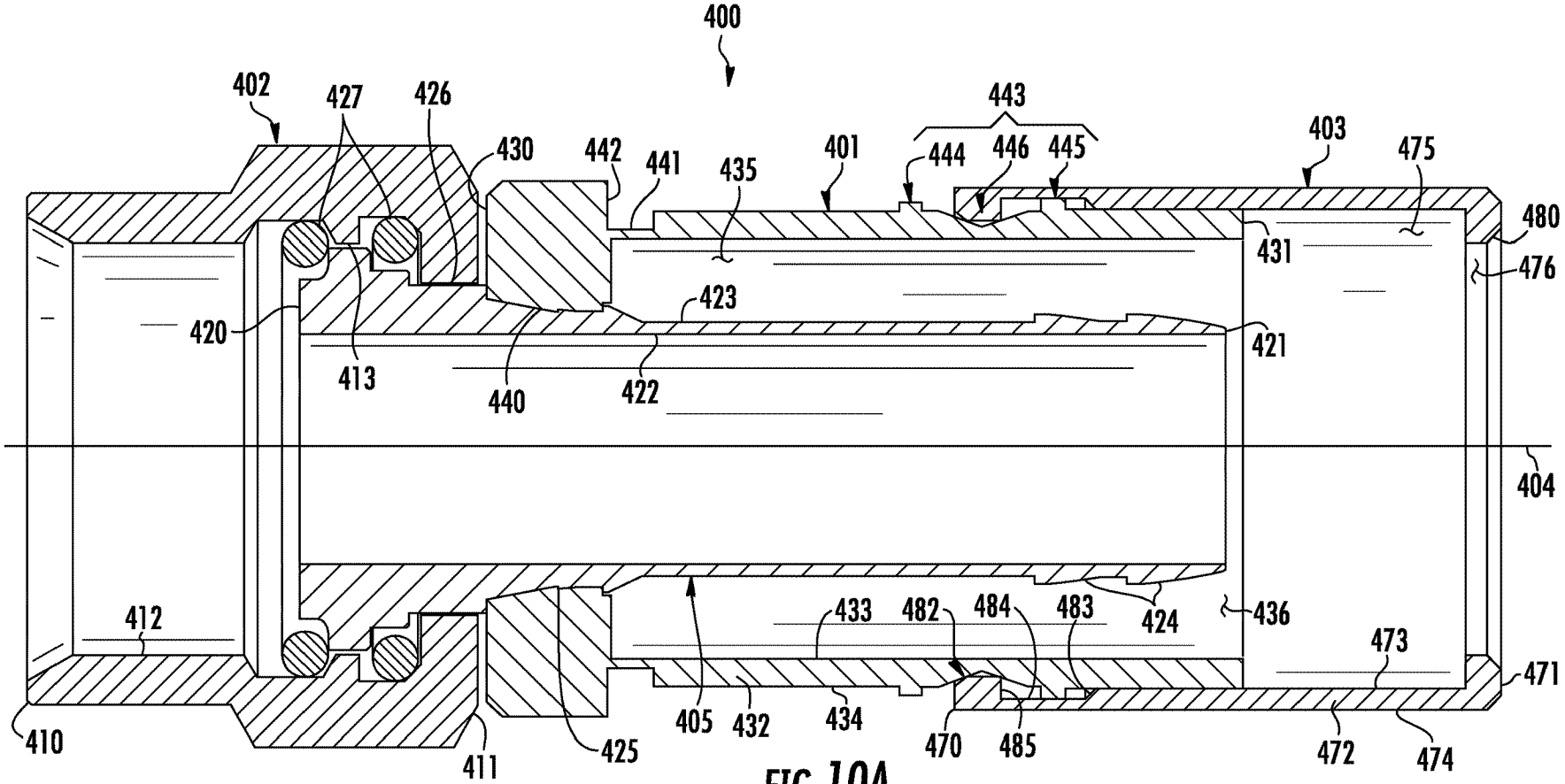
FIGS. 10A and 10B are section views of the coaxial cable connector of FIG. 9 taken along the line 10-10 in FIG. 9, showing the connector in entirety and in enlarged detail, respectively.

Referring to FIG. 9 and FIG. 10A, which is a section view taken along the line 10-10 in FIG. 9 with the cable 21 hidden from view, the fitting 402 is a sleeve having opposed front and rear ends 410 and 411, an integrally-formed ring portion proximate to the front end 410, and an integrally-formed nut portion proximate to the rear end 411. The ring portion has a smooth annular outer surface and an opposed inner surface 412 which may be smooth, threaded, ribbed, or otherwise configured for engaging with a female RF post of an electronic component. The nut portion of the fitting 402 has a hexagonal outer surface to receive the jaws of a tool and an opposed grooved inner surface 413 to receive gaskets and to engage with the barrel 401 of the connector 400. The inner surface 412 bounds and defines a first cylindrical interior space of the fitting 402, and the inner surface 413 bounds and defines a second cylindrical interior space of the fitting 402, the first and second cylindrical interior spaces being joined in open communication so that an object can be passed or may extend entirely through the fitting 402 in a direction along the longitudinal axis 404. The fitting 402 is constructed of a material or combination of materials having strong, hard, rigid, durable, and high electrically-conductive material characteristics, such as metal.

FIG. 10A shows the fitting 402 mounted for rotation to the inner post 405. The inner post 405 is an elongate sleeve extending along the longitudinal axis 404 and having rotational symmetry thereabout. The inner post 405 has opposed front and rear ends 420 and 421 and opposed inner and outer surfaces 422 and 423. The inner post 405 is a "long" post, extending nearly to the rear end of the barrel 401. In other embodiments of the connector 400, the inner post 405 is a "short" post, such as the type shown in U.S. Pat. No. 9,722,330, the disclosure of which is hereby incorporated by reference. The outer surface 423 at the rear end 421 of the inner post 405 is formed with two annular barbs or ridges 424 projecting toward the front end 420 and radially outward from the longitudinal axis 404. The ridges 424 are laterally or axially spaced apart from each other along the rear end 421 of the inner post 405. The ridges 424 provide grip on the cable 21 applied to the connector 400 to resist withdrawal of the cable from the connector 400, and also provided an increased diameter over which the cable 21 must be passed.

Referring still to the section view of FIG. 10A, the inner post 405 is formed with a series of outwardly-directed flanges proximate to the front end 420. The flanges form tiered steps and dados or channels in the inner post 405, on which the barrel 401, the fitting 402, and gaskets of the connector 400 are carried. An annular, inwardly-directed channel 425 is formed into the outer surface 423 of the inner post 405 and seats a forward flange of the barrel 401. Similarly, an annular face 426 is formed just in front of the channel 425 and seats a rearward flange of the fitting 402. Between the inner surface 413 of the nut portion of the fitting 402 and two of the annular flanges of the inner post 405 are two toroidal volumes in which ring gaskets 427 are carried. The gaskets 427 are constructed of a deformable yet resilient material, such as rubber, which prevents the intrusion of moisture into the connector 400, and maintains a snug fit between the fitting 402 and the inner post 405. The inner post 405 is constructed of a material or combination of materials having hard, rigid, durable, and high electrically-conductive material characteristics, such as metal. The fitting 402 is mounted for free rotation on the inner post 405 about the longitudinal axis 404. To allow free rotation, the gaskets 427 space the nut portion of the fitting 402 just off the inner post 405 in a radial direction, creating a small annular gap between the inner post 405 and the nut portion which allows for slight movement in the radial direction, and which also allows the fitting 402 to rotate with low rolling friction on the gaskets 427. In this way, a permanent, low-friction connection is established that allows the fitting 402 to rotate freely upon the inner post 405 while still maintaining the fitting 402 and the inner post 405 in permanent electrical communication.

The barrel 401 is an elongate, cylindrical sleeve extending along the longitudinal axis 404 with rotational symmetry thereabout, and is constructed of a material or combination of materials having strong, rigid, size memory, shape memory, and electrically-insulative material characteristics, as well as a low coefficient of friction, such as plastic or the like. The barrel 401 has opposed front and rear ends 430 and 431 with a cylindrical sidewall 432 extending therebetween, which sidewall 432 has opposed inner and outer surfaces 433 and 434. The inner surface 433 defines and bounds a cable-receiving interior space 435 shaped and sized to receive the coaxial cable 21, and in which the rear end 421 of the inner post 404 is disposed. An opening 436 at the rear end 431 of the barrel 401 communicates with this interior space 435.

A front flange 440 is at the front end 430 of the barrel 401. The front flange 440 is a large, inwardly-turned annular lip which abuts and is seated in the channel 425 of the inner post 405. The front flange 440 is seated and secured into the channel 425 with a friction fit, thereby securing the barrel 401 on the inner post 405. The sidewall 432 extends rearwardly from the front flange 440, and the front flange 440 has a larger inner diameter and a larger outer diameter than any part of the sidewall 432 behind the front flange 440. Briefly, some terms are used with respect to the embodiment of the connector 400, such as "rearwardly" to refer to direction or location. "Rearwardly," "behind," and similar terms indicate that something extends, is directed, or is located proximate to or toward the rear end 431 of the barrel 401. Conversely, "forwardly," "ahead," and similar terms indicate that something extends, is directed, or is located proximate to or toward the front end 410 of the fitting 402. Just behind the front flange 440, an annular groove 441 is formed into the outer surface 434. The annular groove 441 has a reduced outer diameter with respect to the outer surface 434 along the rest of the sidewall 432. The groove 441 cooperates to define a rear face 442 of the front flange 440.

Between the groove 441 and the rear end 431, a compression band 443 is defined in the barrel 401. The compression band 443 is configured to deform in response to axial compression of the connector 400. The compression band 443 is shown in FIG. 10A and is shown in more detail in FIG. 10B. In this embodiment of the connector 400, the compression band 443 includes a first or forward ridge 444, a second or rearward ridge 445, and a thinned portion 446 of the sidewall 432 therebetween.

The first and second ridges 444 and 445 are identical in structure. Each is annular and upstanding, and formed integrally and monolithically to the sidewall 432 on the outer surface 434. The first ridge 444 includes an axially-directed, radially-extending front face 450, an axially-directed, radially-extending rear face 451, and a radially-directed, circumferential outer face 452 which extends axially between the front and rear faces 450 and 451 and is normal to both. As such, the outer face 452 is parallel to the outer surface 434 of the barrel 401, and the front and rear faces 450 and 451 are both normal to the outer surface 434. The outer face 452 thus defines sharp ninety-degree corners with each of the front and rear faces 450 and 451. Similarly, the second ridge 445 includes an axially-directed, radially-extending front face 453, an axially-directed, radially-extending rear face 454, and a radially-directed, circumferential outer face 455 which extends axially between the front and rear faces 453 and 454 and is normal to both. As such, the outer face 455 is parallel to the outer surface 434 of the barrel 401, and the front and rear faces 453 and 454 are both normal to the outer surface 434. The outer face 455 thus defines sharp ninety-degree corners with each of the front and rear faces 453 and 454.

The first and second ridges 444 and 445 extend upwardly away from the outer surface 434, or radially outward from the outer surface 434, to an outer diameter greater than the rest of the sidewall 432 but for the outer diameter of the front flange 440. As such, the first and second ridges 444 and 445 define protrusions from the outer surface 434 to prevent an object from sliding laterally along the outer surface 434. The first and second ridges 444 and 445 flank the thinned portion 446 and are slightly axially spaced apart from the thinned portion 446.

The thinned portion 446 of the sidewall 432 is a reduced-thickness portion of the sidewall 432, which allows the sidewall 432 to deform and flex. The thinned portion 446 includes an oblique first face 460 and an opposed oblique second face 461 which cooperate to form an annular V-shaped notch extending continuously around the barrel 401. The oblique first and second faces 460 and 461 converge radially inward at the same angle with respect to the outer surface 434, toward a bend point 462, which is actually a bend, bend line, or fold extending continuously around the barrel 401. The bend point 462 is a living hinge between the oblique first and second faces 460 and 461.

The oblique first face 460 is an interference face formed proximate to the first ridge 444 and directed toward the rear end 431. It extends from the outer surface 434, radially-inward and rearwardly to the bend point 462. When the compression collar 403 is in the retracted position, the oblique first face 460 is oriented approximately twenty to thirty degrees with respect to the outer surface 434, though one having ordinary skill in the art will appreciate that this angle is not critical and is not critical for proper functioning of the compression band 443, nor are many other angles of orientation unsuitable for the oblique first face 460.

The oblique second face 461 is an interference face formed proximate to the second ridge 445 and directed toward the front end 430 It extends from the outer surface 434, radially-inward and forwardly to the bend point 462. When the compression collar 403 is in the retracted position, the oblique second face 461 is oriented approximately twenty to thirty degrees with respect to the outer surface 434, though one having ordinary skill in the art will appreciate that this angle is not critical and is not critical for proper functioning of the compression band 443, nor are many other angles of orientation unsuitable for the oblique second face 461.

The oblique first and second faces 460 and 461 are coextensive, having the same lengths from the outer surface 434 to the bend point 462.

The barrel 401 is substantially rigid over its entire length except at the compression band 443. In other words, deformation of the barrel 401, and of the sidewall 432, is substantially limited to the compression band 443. Movement of the compression collar 403 over the barrel 401 causes deformation of the barrel 401, and causes it only at the compression collar 403. The compression collar 403 imparts no deformation or compression to any other part of the sidewall 432. In other words, the compression collar 403 is mounted to the barrel 401 for axial movement between the retracted position and the advanced position in which the sidewall 432 is deformed radially inward only at the compression band 443.

Figure 10B:
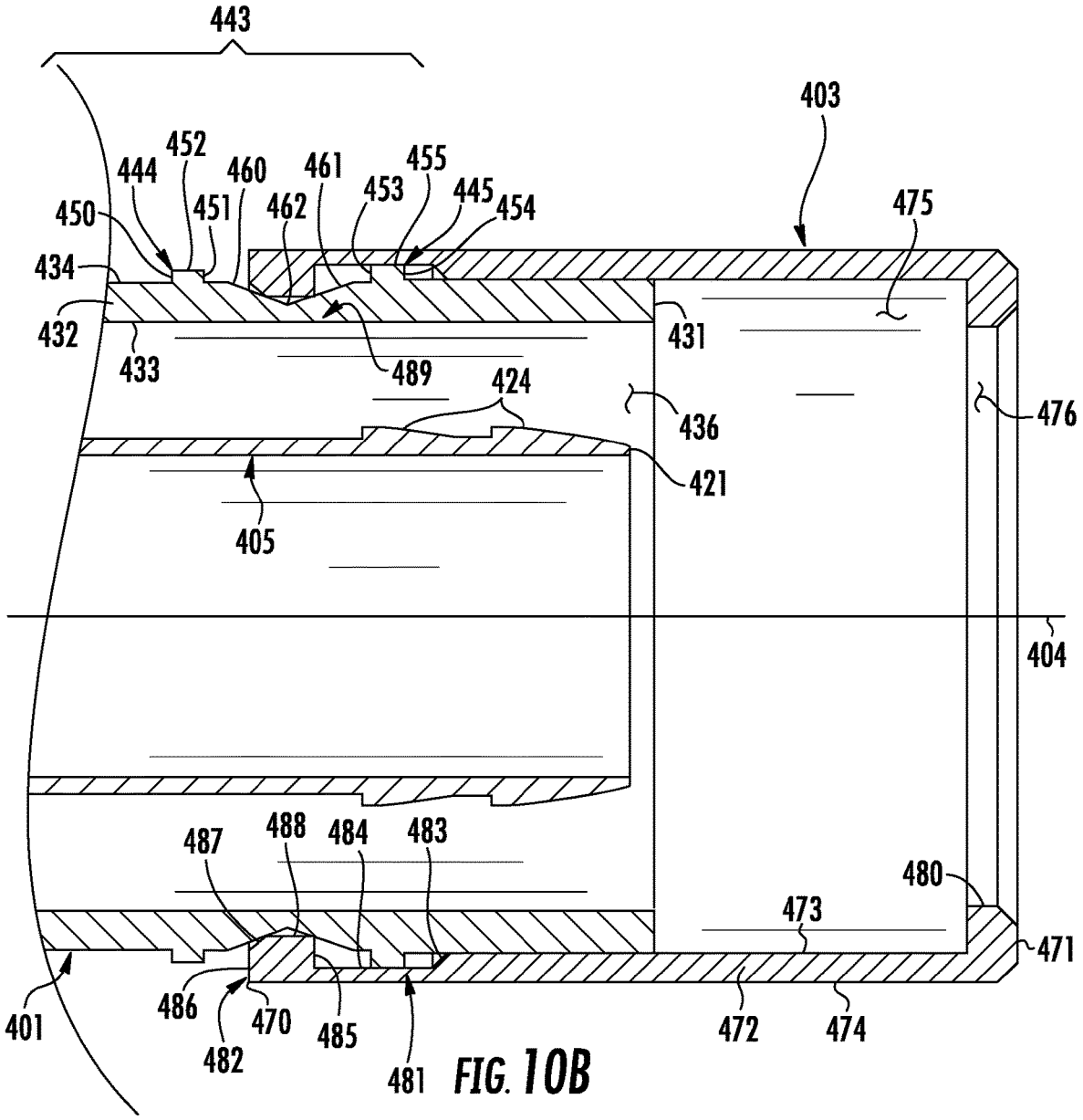

The compression collar 403 is shown in FIGS. 10A and 10B. It includes opposed front and rear ends 470 and 471, an annular sidewall 472 extending between the front and rear ends 470 and 471, and opposed inner and outer surfaces 473 and 474. An interior space 475 bound by the inner surface 473 extends into the compression collar 403 from a rear opening 476 formed at the rear end 471 of the compression collar 403 to a forward opening formed at the front end 470 of the compression collar 403. The interior space 475 is a cylindrical bore and is sized to receive the barrel 401 with the coaxial cable 21 carried within. The compression collar 403 is fit onto the rear end 431 of the barrel 401 to limit the relative radial, axial, and rotational movement of the barrel 401 and the compression collar 403 about and along the longitudinal axis 404. The compression collar 403 is constructed of a material or combination of materials having strong, hard, rigid, and durable material characteristics, such as metal, plastic, or the like. The compression collar 403 does not deform in response to movement between its retracted and advanced positions.

The compression collar 403 has a constant outer diameter from the front end 470 to just before the rear end 471. Most of the length of the sidewall 472 also has a constant inner diameter. However, there are a few features on the compression collar 403 which have a smaller inner diameter. At the rear end 471, the sidewall 472 has an inwardly-directed lip 480. The lip 480 has a reduced inner diameter relative the rest of the compression collar 403, and its inner diameter corresponds to the inner diameter of the barrel 401 at its rear end 431. The lip 480 serves as a stop against barrel 401, in such that the lip 480 contacts the rear end 431 of the barrel 401 and prevents the compression collar 403 from moving beyond the advanced position on the barrel 401.

The inner diameter of the compression collar 403 is constant from the lip 480 forward, until a groove 481 and a ring 482 at the front end 470 of the compression collar 403.

The groove 481 extends into the sidewall 472; the ring 482 projects out of it, in toward the longitudinal axis 404.

The groove 481 is an annular depression extending radially into the sidewall 472 from the inner surface 473. It has an oblique rear face 483 directed forward and an inner face 484 parallel to the longitudinal axis 404. The groove 481 is defined at its front by a rear face 485 of the ring 482. The thickness of the sidewall 472 at the groove 481 is approximately half the thickness of the sidewall 472 behind the groove 481, or between the groove 481 and the lip 480.

The ring 482 is an annular constriction extending radially into the interior space 475, defining a constricted mouth 489 of the compression collar 403. The thickness of the ring 482, between its inner and outer diameters, is approximately twice the thickness of the sidewall 472 between its inner and outer surfaces 473 and 474. The ring 482 is a projection extending radially inward. It includes a blunt front face 486, an oblique face 487, an inner face 488, and the rear face 485. The front face 486 is normal to the longitudinal axis 404, and the inner face 488 is parallel to it. The oblique face 487 extends between the front and inner faces 486 and 488 at approximately a forty-five degree angle, though other angles are suitable as well. The rear face 485 of the ring 482 is normal to the longitudinal axis 404 and is directed toward the rear end 471 of the compression collar 403.

Figure 11A:
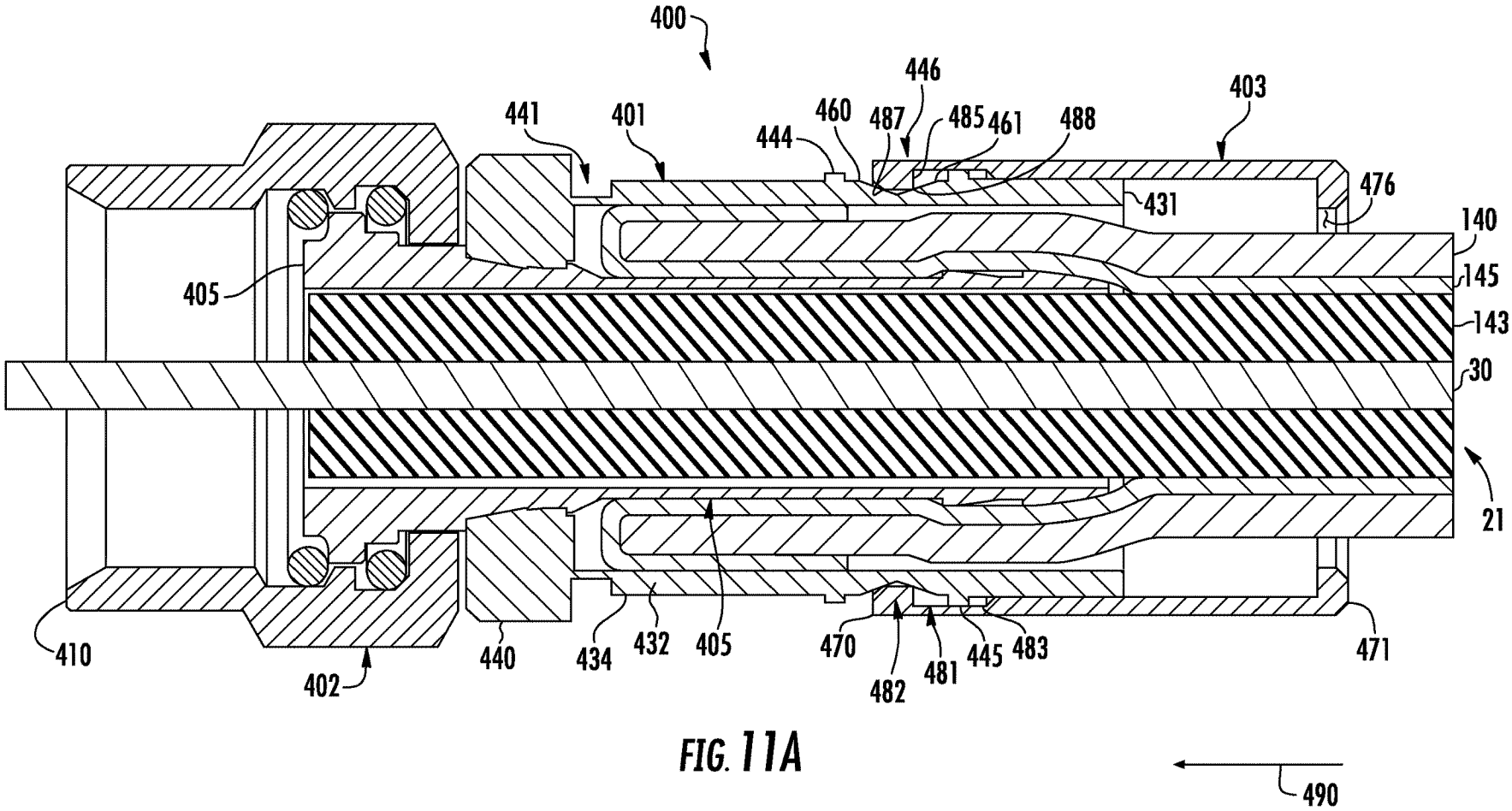
FIGS. 11A-11C are section views of the coaxial cable connector of FIG. 9 taken along the line 10-10 showing a sequence of steps of installing the coaxial cable connector on the coaxial cable.
Figure 11B:
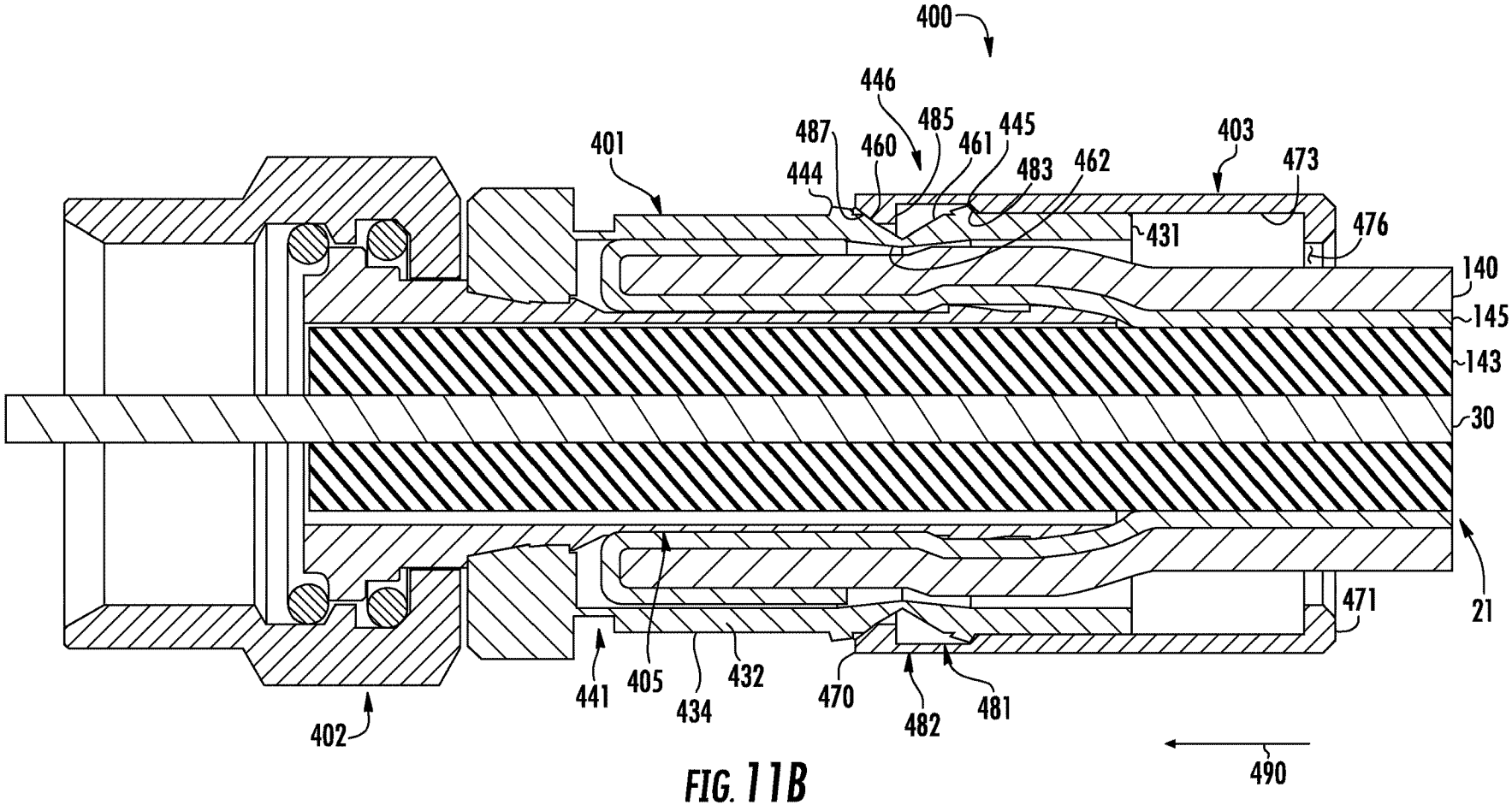
Figure 11C:
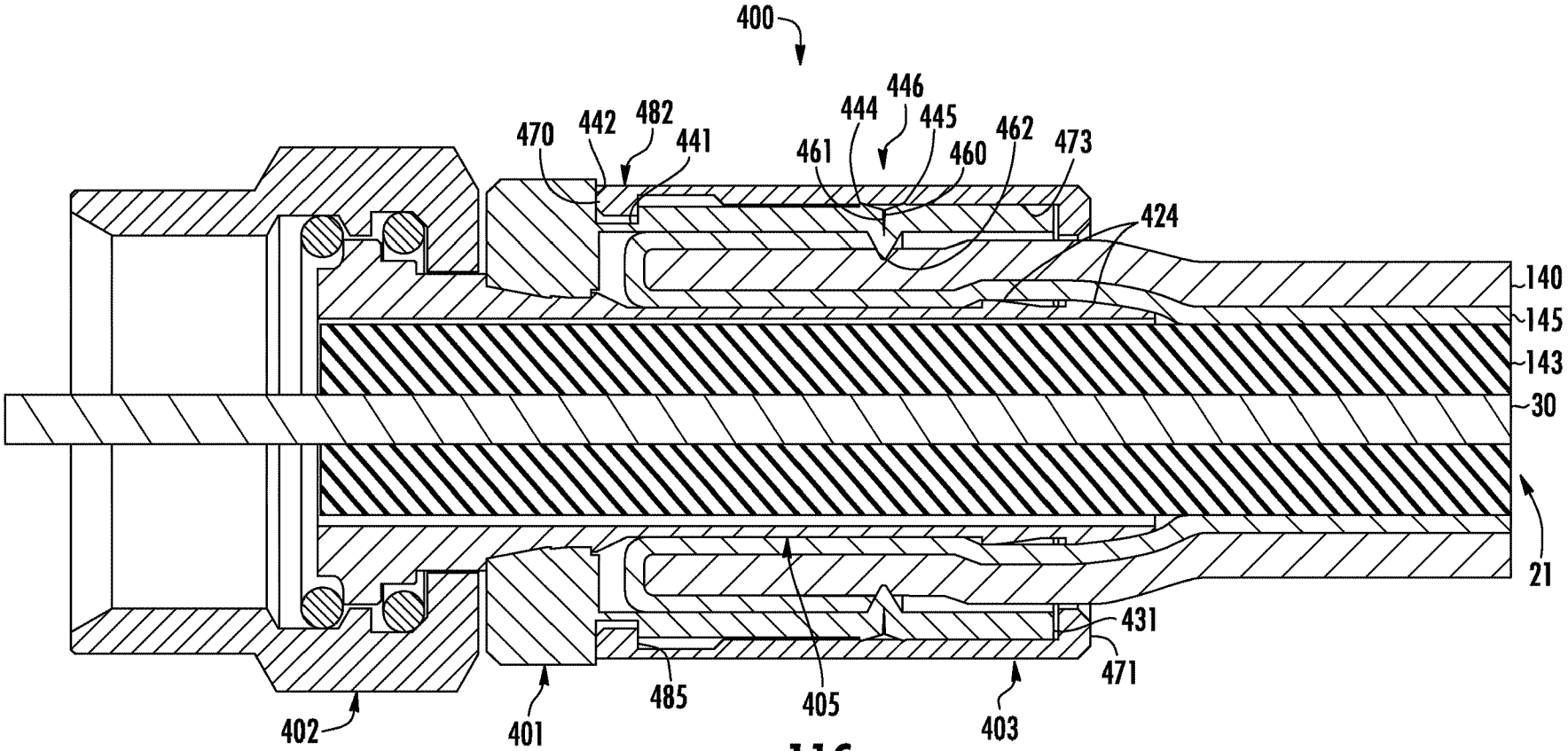

In operation, the cable connector 400 is useful for coupling the coaxial cable 21 to an electronic component in electrical communication, which is accomplished in part through a series of steps shown in FIGS. 11A-11C. The coaxial cable 21 must be prepared before installation. Preparation is conventional and need not be described in detail, but involves stripping back the jacket 140 to expose the inner conductor 30, a dielectric insulator 143, and a flexible shield 145.

The prepared end of the coaxial cable 21 is introduced to the connector 400 by registering the inner conductor 30 with the rear opening 476 and advancing the cable 21 therethrough. The connector 400 is initially in an uncompressed condition and the compression collar 403 is in the retracted position, as shown in FIG. 11A. In the retracted position of the compression collar 403, the front end 470 of the compression collar 403 is behind the first ridge 444, the rear end 471 is considerably off of the rear end 431 of the barrel 401, and the compression collar 403 does not compress, deform, or bias the barrel 401 of the compression band 443 of the barrel 401. Rather, the compression collar 403 is merely fit to the barrel 401, prevented from sliding off by interaction of the ring 482 and the second ridge 445. Further characteristics of the retracted position are described below.

The coaxial cable 21 is advanced into the interior space 475 and over the inner post 405 until the dielectric insulator 143 is proximate to the front end 420 of the inner post 405, the jacket 140 (with the flexible shield 145 bent over it) is proximate to the front flange 440, and the center conductor 30 extends just beyond the front end 410 of the fitting 402. In this arrangement, the coaxial cable 21 is fully applied into the connector 400, but the connector 400 is not secured on the coaxial cable 21.

To secure the connector 400 on the coaxial cable 21, the compression collar 403 is advanced forwardly along the direction indicated by the arrowed line 490 in FIG. 11A. Briefly, forward movement of the compression collar 403 is preferably accomplished by a compression tool, but in some cases may be possible manually by hand. Forward advancement moves this compression collar 403 forwardly over the barrel 401 out of the retracted position. The ring 482 is initially disposed, in the retracted position, in the thinned portion 446 of the sidewall 432. The oblique face 487 of the ring 482 is in contact against the oblique first face 460 of the thinned portion 446, and the corner between the rear face 485 and the inner face 488 is in contact against the oblique second face 461. The ring 482 is thus seated in the annular V-shaped notch extending continuously around the barrel 401. The groove 481 overlies the second ridge 445, and the oblique rear face 483 of the groove 481 is behind the second ridge 445, while the ring 482 is in front of it.

When the compression collar 403 is advanced forward along the arrowed line 490, the oblique face 487 moves forward. Because the compression collar 403 is rigid and durable, the ring 482 does not deflect or deform. Instead, the ring 482 imparts deformation: the oblique face 487 rides along the oblique first face 460 which deforms radially inwardly in response. The two oblique surfaces of the oblique face 487 and the oblique first face 460 slide along each other, and the angle between causes the front section of the thinned portion 446 of the sidewall 432 to flex and bend inwardly. This is seen in FIG. 11B.

Simultaneously with the oblique face 487 deforming the oblique first face 480, the oblique rear face 483 of the groove 481 impacts the second ridge 445. Both the first and second ridges 444 and 445 are integrally formed to sidewall 432 of the barrel 401. As the oblique rear face 483 encounters the second ridge 445, the second ridge 445 causes the back section of the thinned portion 446 of the sidewall 432 to deform. The second ridge 445 pivots forward with the deforming thinned portion 446, causing the rear corner of the second ridge to point nearly directly radially outward, away from the outer surface 434 of the barrel 401.

Thus, as the ring 482 (with the impingement of the oblique face 487 against the oblique first face 460) is urging the thinned portion 446 into deformation, so too is the groove 481 (with the impingement of the oblique rear face 482 against the second ridge 445). In other words, movement of the compression collar 403 from the retracted position toward the advanced position brings the compression collar 403 into engagement with the second ridge 445 and into engagement with the thinned portion 446 of the sidewall 432, and both of these engagements urge the sidewall 432 into deformation at the compression band 443 as the compression collar 403 moves from the retracted position toward the advanced position. The thinned portion 446 of the sidewall 432 is therefore urged into deformation and axial compression by the compression collar 403 at both its front and rear ends. The bend point 462 deforms radially inward, toward the jacket 140 of the coaxial cable 21.

Continued forward movement of the compression collar 403 over the barrel 401 along the line 490 moves the compression collar 403 into the advanced position thereof, as shown in FIG. 11C. In the advanced position of the compression collar 403, the compression collar 403 is slid fully over the barrel 401, and the front end 470 of the compression collar 403 is in contact against the rear face 442 of the front flange 440 of the barrel 401. The description below describes the movement of the compression collar into the advanced position from FIG. 11B to FIG. 11C.

The ring 482 is snappedly received and seated into the annular groove 441 just behind the front flange 440: as the compression collar 403 is advanced forwardly, the ring 482 expands slightly to accommodate the outer diameter of the barrel 401, which is slightly larger between the first ridge 444 and the annular groove 441 than it is at the thinned portion 446. When the ring 482 reaches the annular groove 441, which has a smaller outer diameter than the rest of the barrel 401 behind it, the ring 482 snaps into the annular groove 441. The rear face 485 of the ring 482 is received against the rear wall of the annular groove 441, preventing the compression collar 403 from being drawn back out of the advanced position.

As the compression collar 403 is moved into the advanced position, the compression band 443 deforms radially. The oblique rear face 483 urges the second ridge 445 forward and slightly radially inward, thereby pushing the thinned portion 446 into the interior of the connector 400 and into the coaxial cable 21, until the thinned portion 446 is fully deformed, collapsed so that the oblique first and second faces 460 and 461 are in confrontation with each other, in direct, flush, and coextensive contact. The bend point 462 is pushed radially inward and extends into the jacket 140 of the coaxial cable 21, "biting" into it similarly to an annular barb, so as to engage the jacket 140 and prevent relative axial movement of the jacket 140 and the bend point 462 (and thus the barrel 401). Opposed from and axially flanking the bend point 462 are the first and second ridges 444 and 445. With the compression band 443 deformed, the front corner of the first ridge 444 and the back corner of the second ridge 445 are directed radially outward into biting engagement with the inner surface 473 of the compression collar 403, thereby preventing relative axial movement of the barrel 401 and the compression collar 403. In other words, the first and second ridges 444 and 445 bite into the inner surface 473 of the compression collar 403 in the same manner in which a barb does: each projects into the inner surface 473 with a sharp edge which prevents relative axial movement of the inner surface 473 and the respective first and second ridges 444 and 445.

In short, several engagements prevent relative movement of the compression collar 403, the barrel 401, and the coaxial cable 21: the snapped seating of the ring 482 in the annular groove 441, the biting engagement of the bend point 462 in the jacket 140, the biting engagement of the first and second ridges 444 and 445 into the compression collar 403. Further, the annular barbs or ridges 424 prevent retraction of the cable 21 on the inner post 405. In this manner, the connector 400 is secured on the coaxial cable, and the connector 400 is ready for application to an electronic component.

Figure 12:
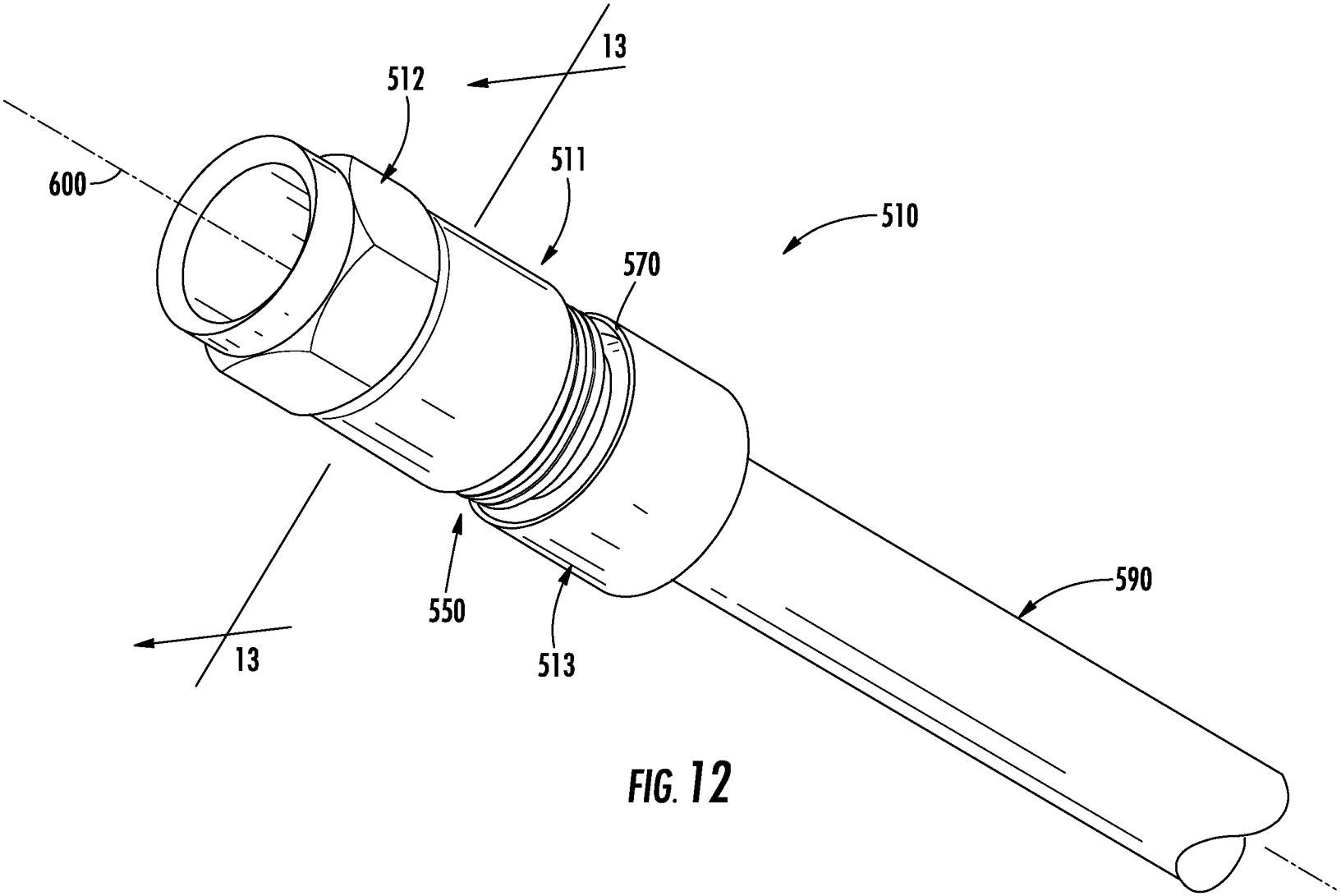
FIG. 12 is a perspective view of an embodiment of a coaxial cable connector applied to a coaxial cable.

FIG. 12 is a section view of an embodiment of a coaxial cable connector 510 for use with an RG6 coaxial cable (for exemplary and non-limiting purposes). The connector 510 includes a body or barrel 511, a coupling nut or fitting 512 mounted for rotation on the barrel 511, and a compression collar 513 mounted to the barrel 511 for axial movement between a retracted (shown in FIG. 13) and an advanced position (shown in FIG. 15) with respect to the barrel 511. The connector 510 has rotational symmetry with respect to a longitudinal axis 600. The barrel 511 and the fitting 512 are mounted coaxially on an inner post 514.

Figure 13:
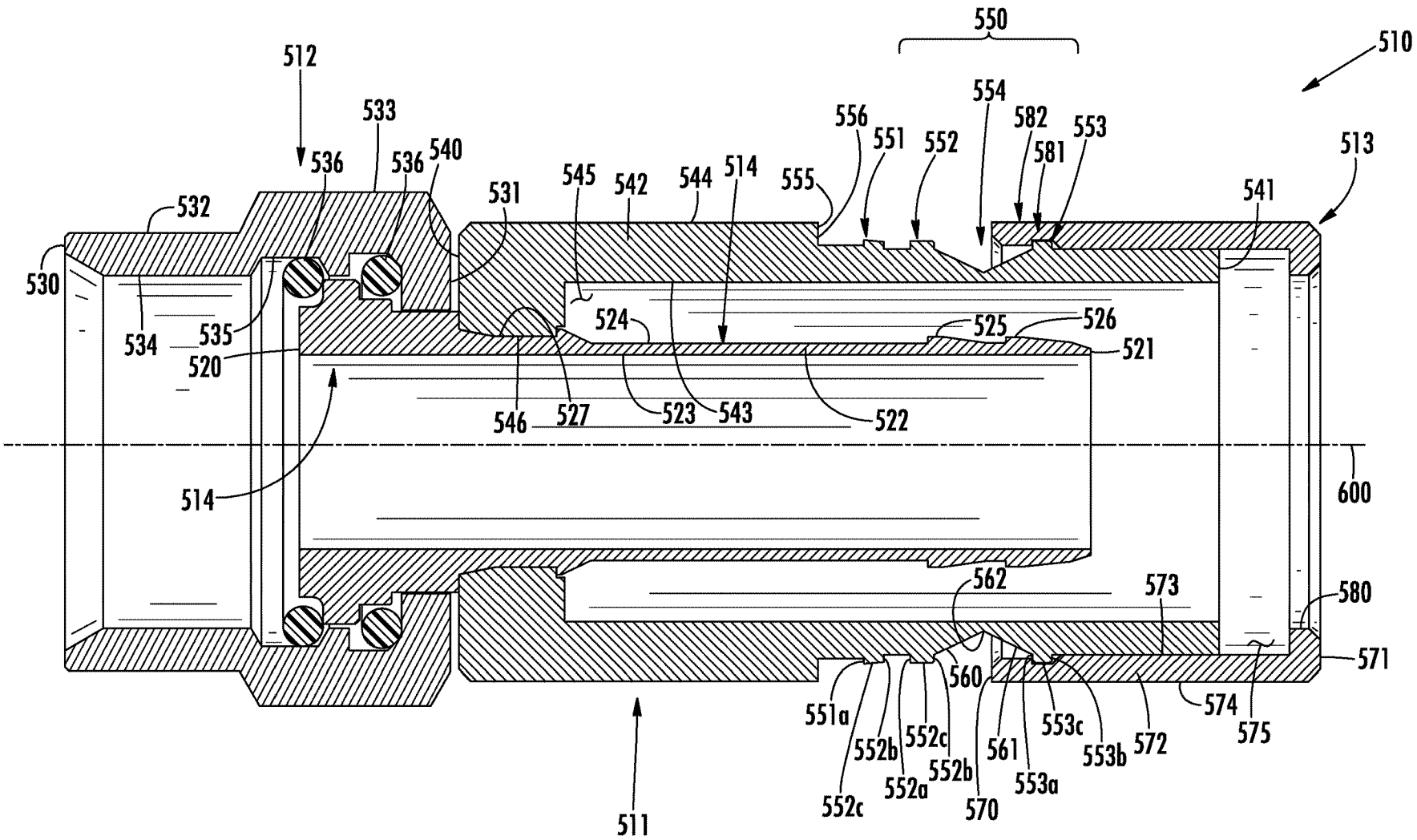
FIGS. 13-15 are section views of the coaxial cable connector of FIG. 12 taken along the line 13-13 therein, showing the connector in various stages of axial compression.

Referring now also to FIG. 13, the inner post 514 is an elongate sleeve extending along the longitudinal axis 600 and having rotational symmetry thereabout. The inner post 514 includes opposed front and rear ends 520 and 521, a sidewall 522 extending therebetween, and opposed inner and outer surfaces 523 and 524. The inner post 514 is a "long" post, extending nearly to the rear end of the barrel 511. In other embodiments of the connector 510, the inner post 514 is a "short" post, such as the type shown in U.S. Pat. No. 9,722,330, the disclosure of which is hereby incorporated by reference. The outer surface 524 at the rear end 521 of the inner post 514 is formed with two annular barbs or ridges 525 and 526 projecting toward the front end 520 and radially outward from the longitudinal axis 600. The ridges 525 and 526 are laterally or axially spaced apart from each other along the rear end 521 of the inner post 514. The ridges 525 and 526 provide grip on a cable applied to the connector 510 to resist withdrawal of the cable from the connector 510, and also provide an increased diameter over which the cable must be passed.

The fitting 512 is mounted for rotation at the front end 520 of the inner post 514. The fitting 512 is a sleeve having opposed front and rear ends 530 and 531, an integrally-formed ring portion 532 proximate to the front end 530, and an integrally-formed nut portion 533 proximate to the rear end 531. The ring portion has a smooth annular outer surface and an opposed inner surface 534 which may be smooth, threaded, ribbed, or otherwise configured for engaging with a female RF mating post of an electronic component. The nut portion of the fitting 512 has a hexagonal outer surface to receive the jaws of a tool and an opposed grooved inner surface 535 to receive gaskets and to engage with the barrel 511 of the connector 510. The fitting 512 is constructed of a material or combination of materials having strong, hard, rigid, durable, and high electrically-conductive material characteristics, such as metal. Gaskets 536 disposed between the inner post 514 and the fitting 512 are constructed of a deformable yet resilient material, such as rubber, which prevents the intrusion of moisture into the connector 510, and maintains a snug fit between the fitting 512 and the inner post 514. In this way, a permanent, low-friction connection is established that allows the fitting 512 to rotate freely upon the inner post 514 about the axis 600 while still maintaining the fitting 512 and the inner post 514 in permanent electrical communication.

Still referring to FIG. 13, the barrel 511 is an elongate, cylindrical sleeve extending along the longitudinal axis 600 with rotational symmetry thereabout, and is constructed of a material or combination of materials having strong, rigid, size memory, shape memory, and electrically-insulative material characteristics, as well as a low coefficient of friction, such as plastic or the like. The barrel 511 has opposed front and rear ends 540 and 541 with a cylindrical sidewall 542 extending therebetween, which sidewall 542 has opposed inner and outer surfaces 543 and 544. The inner surface 543 bounds and defines a cable-receiving interior space 545 shaped and sized to receive the coaxial cable 521, and in which the rear end 521 of the inner post 514 is disposed. An opening at the rear end 541 of the barrel 511 communicates with this cable-receiving interior space 545.

A front flange 546 is at the front end 540 of the barrel 511. The front flange 546 is a large, inwardly-directed annular lip which abuts and is seated in an annular channel 527 behind the front end 520 of the inner post 514. The front flange 546 is seated and secured into the channel 527 with a friction fit, thereby securing the barrel 511 on the inner post 514. The sidewall 542 of the barrel 511 extends rearwardly from the front flange 546, and the front flange 546 has a smaller inner diameter than any other part of the sidewall 542 behind the front flange 546. Indeed, behind the front flange 546, the inner diameter of the barrel 511 is preferably constant while the barrel is uncompressed. The outer diameter of the barrel 511 is constant from the front end 540 to a compression band 550 formed in the sidewall 542. Briefly, some terms are used with respect to the embodiment of the connector 510, such as "rearwardly" to refer to direction or location. "Rearwardly," "behind," and similar terms indicate that something extends, is directed, or is located proximate to or toward the rear end of the connector 510 (proximate to or toward the rear ends 521 and 541). Conversely, "forwardly," "ahead," and similar terms indicate that something extends, is directed, or is located proximate to or toward the front end of the connector 510 (proximate to or toward the front end 520).

The compression band 550 is a thinned portion of the of the sidewall 542, configured to deform in response to axial compression of the connector 510. It is thinned with respect to the sidewall 542 proximate the front end 540, and portion of the compression band 550 are more thinned than others, as will be explained. In this embodiment of the connector 510, the compression band 550 includes an intermediate or first ridge 552, a rearward or third ridge 553, and a notch 554 formed in the sidewall 542 between the intermediate and rearward ridges 552 and 553. A forward ridge 551 is also formed in the sidewall 542 in front of the intermediate ridge 552. The compression band 550 defines a reduced outer diameter of the barrel 511 with respect to the outer diameter in front of the compression band 550, proximate to the front end 540. A shoulder 555, directed rearward, drops from that larger outer diameter to the smaller outer diameter of the compression band 550, presenting an abutment face 556 rearwardly. From the shoulder 555, the outer surface 544 extends axially rearwardly to the forward ridge 551. The forward ridge 551 projects radially outwardly from the outer surface 544. From the forward ridge 551, the outer surface 544 extends axially rearwardly to the intermediate ridge 552. The intermediate ridge 552 projects radially outwardly from the outer surface 544. The portion of the outer surface 544 between the forward and intermediate ridges 552 and 553 has a slightly decreased outer diameter with respect to the portion of the outer surface 544 between the forward ridge 552 and the shoulder 555.

Still referring to FIG. 13, the forward, intermediate, and rearward ridges 551, 552, and 553 are nearly identical in structure. Each is annular and upstanding, and formed integrally and monolithically to the sidewall 542 on the outer surface 544 of the barrel 511, projecting radially outward to roughly the same distance. The forward ridge 551 includes an axially-directed, radially-extending front face 551*a*, an axially-directed, radially-extending rear face 551*b*, and a radially-directed, axially-extending circumferential outer face 551*c* which extends nearly axially between the front and rear faces 551*a* and 551*b*. The outer face 551*c* is oriented slightly radially outward from the rear face 551*b* to the front face 551*a*, so that it is not quite parallel to the axis 600 but in fact converges or tapers toward the rear end of the connector 510. The front and rear faces 551*a* and 551*b* are both normal to the outer surface 544, however. The outer face 551*c* thus defines sharp corners with each of the front and rear faces 551*a* and 551*b*; while the corner formed between the outer face 551*c* and the rear face 551*b* is slightly obtuse, the corner formed between the outer face 551*c* and the front face 551*a* is slightly acute.

The intermediate ridge 552 includes an axially-directed, radially-extending front face 552*a*, an axially-directed, radially-extending rear face 552*b*, and a radially-directed, axially-extending circumferential outer face 552*c* which extends axially between the front and rear faces 552*a* and 552*b* and is normal to both. As such, the outer face 552*c* is parallel to the longitudinal axis 600, and the front and rear faces 552*a* and 552*b* are both normal to the outer surface 544. The outer face 552*c* thus defines sharp ninety-degree corners with each of the front and rear faces 552*a* and 552*b*.

Similarly, the rearward ridge 553 includes an axially-directed, radially-extending front face 553*a*, an axially-directed, radially-extending rear face 553*b*, and a radially-directed, axially-extending circumferential outer face 553*c* which extends axially between the front and rear faces 553*a* and 553*b* and is normal to both. As such, the outer face 553*c* is parallel to the longitudinal axis 600, and the front and rear faces 553*a* and 553*b* are both normal to the outer surface 544. The outer face 553*c* thus defines sharp ninety-degree corners with each of the front and rear faces 553*a* and 553*b*.

The forward, intermediate, and rearward ridges 551, 552, and 53 extend upwardly away from the outer surface 544, or radially outward from the outer surface 544, to outer diameters greater than the rest of the sidewall 542 but for the outer diameter of the front flange 546 proximate the front end 540. As such, the forward, intermediate, and rearward ridges 551 and 53 define protrusions from the outer surface 544 which limit an object from sliding laterally along the outer surface 544. The intermediate and rearward ridges 552 and 53 flank the notch 554 and are axially spaced apart by the notch 554.

The notch 554 of the sidewall 542 is a reduced-thickness portion of the sidewall 542 that allows the sidewall 542 to deform and flex. The notch 554 includes an oblique first face 560 and an opposed oblique second face 561 which cooperate to form an annular V-shaped notch extending continuously around the barrel 511, into the barrel 511 from the outer surface 544. The oblique first and second face 560 and 561 converge radially inward at the same angle with respect to the outer surface 544, toward the bend point 562, which is actually an annular bend, bend line, or fold extending continuously around the barrel 511. The bend point 562 is a living hinge between the oblique first and second face 560 and 561; it flexes in response to movement of the first and second face 560 and 561.

The oblique first face 560 is an interference face formed just behind yet still proximate to the intermediate ridge 552 and directed toward the rear end 541 of the barrel 511. It extends directly from the rear face 551*b*, radially-inwardly and rearwardly, to the bend point 562. When the compression collar 513 is in the retracted position (as in FIG. 13), the oblique first face 560 is oriented approximately twenty to thirty degrees with respect to the outer surface 544, though one having ordinary skill in the art will appreciate that this angle is not critical and is not critical for proper functioning of the compression band 550, and many other angles of orientation are suitable for the oblique first face 560.

The oblique second face 561 is an interference face formed just ahead yet still proximate to the rearward ridge 553 and directed toward the front end 540 of the barrel 511. It extends directly from the outer surface 544, radially-inwardly and forwardly, to the bend point 562. When the compression collar 513 is in the retracted position, the oblique second face 561 is oriented approximately twenty to thirty degrees with respect to the outer surface 544, though one having ordinary skill in the art will appreciate that this angle is not critical and is not critical for proper functioning of the compression band 550, and many other angles of orientation are suitable for the oblique second face 561. The oblique first and second face 560 and 561 are coextensive, having the same lengths from the rear face 551*b* and front face 553*a*, respectively, to the bend point 562.

The barrel 511 is substantially rigid over its entire length except at the compression band 550. In other words, deformation of the barrel 511, and of the sidewall 542, is substantially limited to the compression band 550. Movement of the compression collar 513 over the barrel 511 causes deformation of the barrel 511, and causes it only at the compression collar 513. The compression collar 513 imparts no deformation or compression to any other part of the sidewall 542. In other words, the compression collar 513 is mounted to the barrel 511 for axial movement between the retracted position and the advanced position in which the sidewall 542 is deformed radially inward only at the compression band 550.

The compression collar 513 is mounted for reciprocal movement over the barrel 511. It includes opposed front and rear ends 570 and 571, an annular sidewall 572 extending between the front and rear ends 570 and 571, and opposed inner and outer surfaces 573 and 574. An interior space 575 bound by the inner surface 573 extends into the compression collar 513 from an opening formed at the rear end 571 of the compression collar 513 to an opening formed at the front end 570 of the compression collar 513, which opening is in communication with the spaced within the fitting 512. The interior space 575 is a cylindrical bore and is sized to receive the barrel 511 with a coaxial cable carried within. Indeed, the compression collar 513 is fit onto the rear end 541 of the barrel 511 to limit the relative radial movement of the compression collar 513 on the barrel 511 with respect to the longitudinal axis 600. The compression collar 513 is constructed of a material or combination of materials having strong, hard, rigid, and durable material characteristics, such as metal, plastic, or the like. The compression collar 513 does not deform in response to movement between its retracted and advanced positions.

The compression collar 513 has a constant outer diameter from the front end 570 to just in front of the rear end 571. Most of the length of the sidewall 572 also has a constant inner diameter. However, there are a few features on the compression collar 513 which have different inner diameters. Referring still to FIG. 13 but also to FIG. 14, at the rear end 571, the sidewall 572 has an inwardly-directed lip 580. The lip 580 has a reduced inner diameter relative the rest of the compression collar 513, and its inner diameter is just larger than the inner diameter of the barrel 511 at its rear end 541. The lip 580 serves as a stop against the barrel 511, so that, when the compression collar 513 is moved forward, the lip 580 contacts the rear end 541 of the barrel 511 and prevents the compression collar 513 from moving beyond the advanced position on the barrel 511.

The inner diameter of the compression collar 513 is constant from the lip 580 forward, until a groove 581 and a ring 582 at the front end 570 of the compression collar 513. The groove 581 extends into the sidewall 572; the ring 582 projects out of it, toward the longitudinal axis 600. The groove 581 is an annular depression extending radially into the sidewall 572 from the inner surface 573, and has a larger inner diameter than those portions of the sidewall 572 adjacent it. It has an oblique rear face 583 directed axially-forward and radially-outward. It also has an inner face 584 parallel to the longitudinal axis 600. The groove 581 is defined at its front by a radially-extending front face 585 of the ring 582. The thickness of the sidewall 572 at the groove 581 is approximately two-thirds the thickness of the sidewall 572 behind the groove 581, or between the groove 581 and the lip 580.

The ring 582 is an annular constriction extending radially into the interior space 575 within the compression collar 513, defining a constricted mouth of the compression collar 513. The thickness of the ring 582, between its inner and outer diameters (or between the inner and outer surfaces 573 and 574), is approximately equal to the thickness of the sidewall 572 between its inner and outer surfaces 573 and 574. The inner diameter of the ring 582 corresponds to the inner diameter of most of the compression collar 513. The ring 582 is a projection extending radially inward. It includes a blunt front face 586, an oblique face 587, an inner face 588, and the rear face 589. The front face 586 is normal to the longitudinal axis 600, and the inner face 588 is parallel to it. The oblique face 587 extends between the front and inner faces 586 and 588 at approximately a forty-five degree angle, though other angles are suitable as well. The rear face 589 of the ring 582 is normal to the longitudinal axis 600 and is directed toward the rear end 571 of the compression collar 513.

Figure 16:
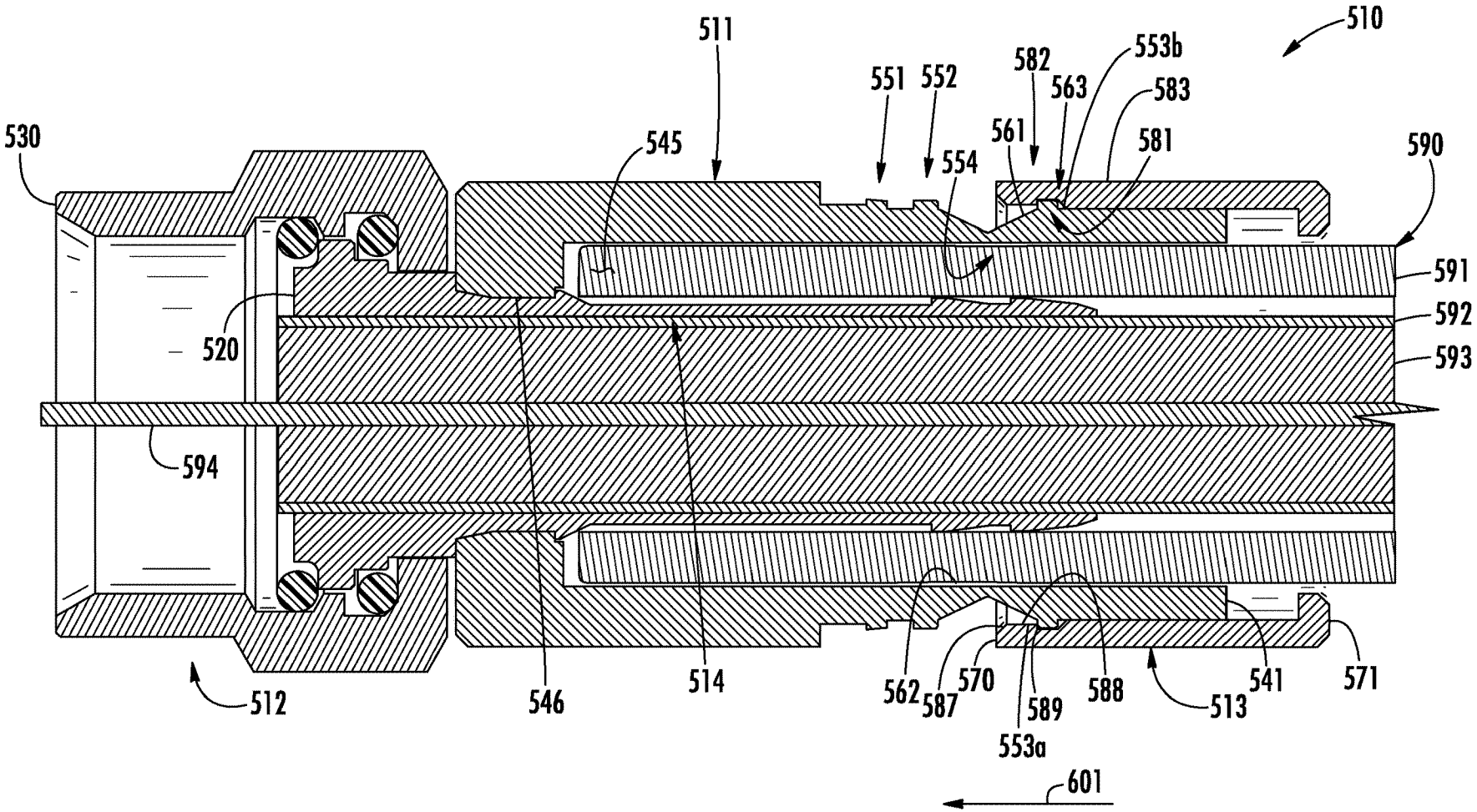
FIGS. 16 and 17 are section views of the coaxial cable connector of FIG. 12 taken along the line 13-13 therein, showing the connector applied on a cable and in various stages of axial compression.
Figure 17:
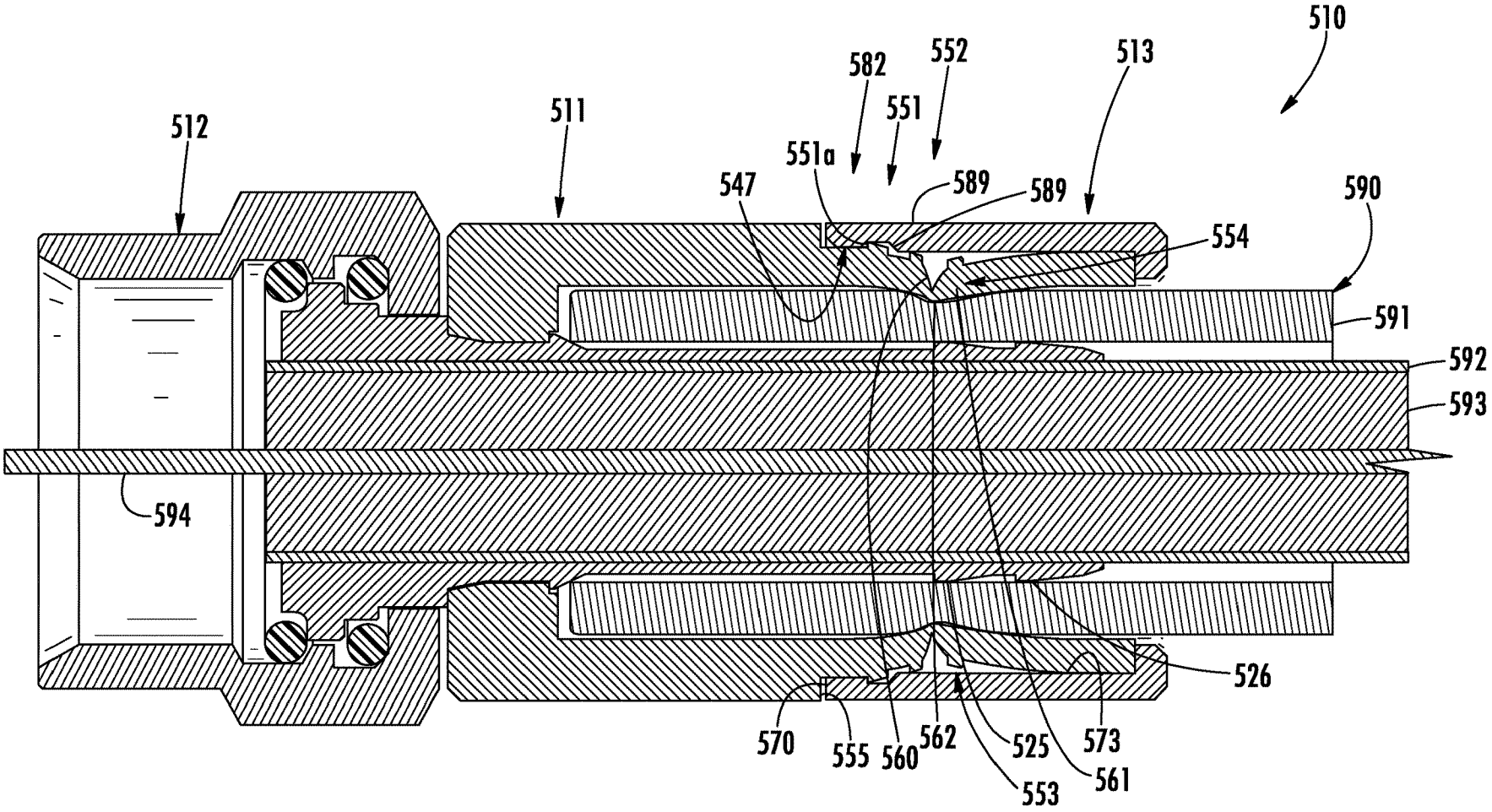

In operation, and referring to FIGS. 16 and 17, the cable connector 510 is useful for coupling a coaxial cable 590 to an electronic component in electrical communication. The coaxial cable 590 must be prepared before installation. Preparation is conventional and need not be described in detail, but involves stripping back the jacket 591 to expose a flexible shield 592, a dielectric insulator 593, and an inner conductor 594.

The prepared end of the coaxial cable 590 is introduced to the connector 510 by registering the inner conductor 594 with the opening at the rear end 571 of the compression collar 513 and advancing the cable 590 therethrough. The connector 510 is initially in an uncompressed condition and the compression collar 513 is in the retracted position, as shown in FIGS. 12 and 16. In the retracted position of the compression collar 513, the front end 570 of the compression collar 513 is behind the forward and intermediate ridges 551 and 552, the rear end 571 is drawn back off of the rear end 541 of the barrel 511, and the compression collar 513 does not compress, deform, or bias the barrel 511 of the compression band 550 of the barrel 511. Rather, the compression collar 513 is merely fit to the barrel 511, prevented from sliding off by interaction of the ring 582 and the rearward ridge 553.

The coaxial cable 590 is advanced into the interior space 545 of the barrel 511 and over the inner post 514 until the dielectric insulator 593 is proximate to the front end 520 of the inner post 514, the jacket 591 is proximate to the front flange 546, and the center conductor 594 extends beyond the front end 530 of the fitting 512. In this arrangement, the coaxial cable 590 is fully applied into the connector 510, but the connector 510 is not yet secured on the coaxial cable 590.

To secure the connector 510 on the coaxial cable, the compression collar 513 is advanced forwardly along the direction indicated by the arrowed line 601 in FIG. 16. Briefly, forward movement of the compression collar 513 is preferably accomplished by a compression tool, but in some cases may be possible manually by hand. Forward advancement moves this compression collar 513 forwardly over the barrel 511 out of the retracted position. In the retracted position, the ring 582 is initially disposed outside of the notch 554 of the sidewall 542, registered with the oblique second face 561. The rear face 589 of the ring 582 is against the front face 553*a* of the rearward ridge 553, the corner between the rear face 589 and the inner face 588 is in contact against the front face 553*a* of the rearward ridge 553, and the inner face 588 of the ring 582 extends forwardly therefrom. The oblique face 587 of the ring 582 is radially outside of the notch 554. The ring 582 is thus disposed above the annular V-shaped notch 554 extending continuously around the barrel 511. The groove 581 overlies the rearward ridge 553, and the oblique rear face 583 of the groove 581 is just behind the rearward ridge 553, while the ring 582 is just in front of it.

When the compression collar 513 is advanced forward along the arrowed line 601, the oblique rear face 583 of the groove 581 moves forward. Because the compression collar 513 is rigid and durable, neither the ring 582 nor the groove 581 deflect or deform. Instead, the groove 581 imparts deformation: the oblique rear face 583 pushes against the rear face 553*b* of the rearward ridge 553 which causes the notch 554 to begin to deform. The oblique angle of the oblique rear face 583 imparts radially inward deformation of the notch 554. Since the notch 554 is V-shaped and opens toward the outside, the notch 554 collapses inwardly in deformation, thereby compressing axially as well. This is shown in FIG. 14 (without the cable 590), which depicts the connector 510 partially compressed between the retracted and advanced position.

Figure 14:
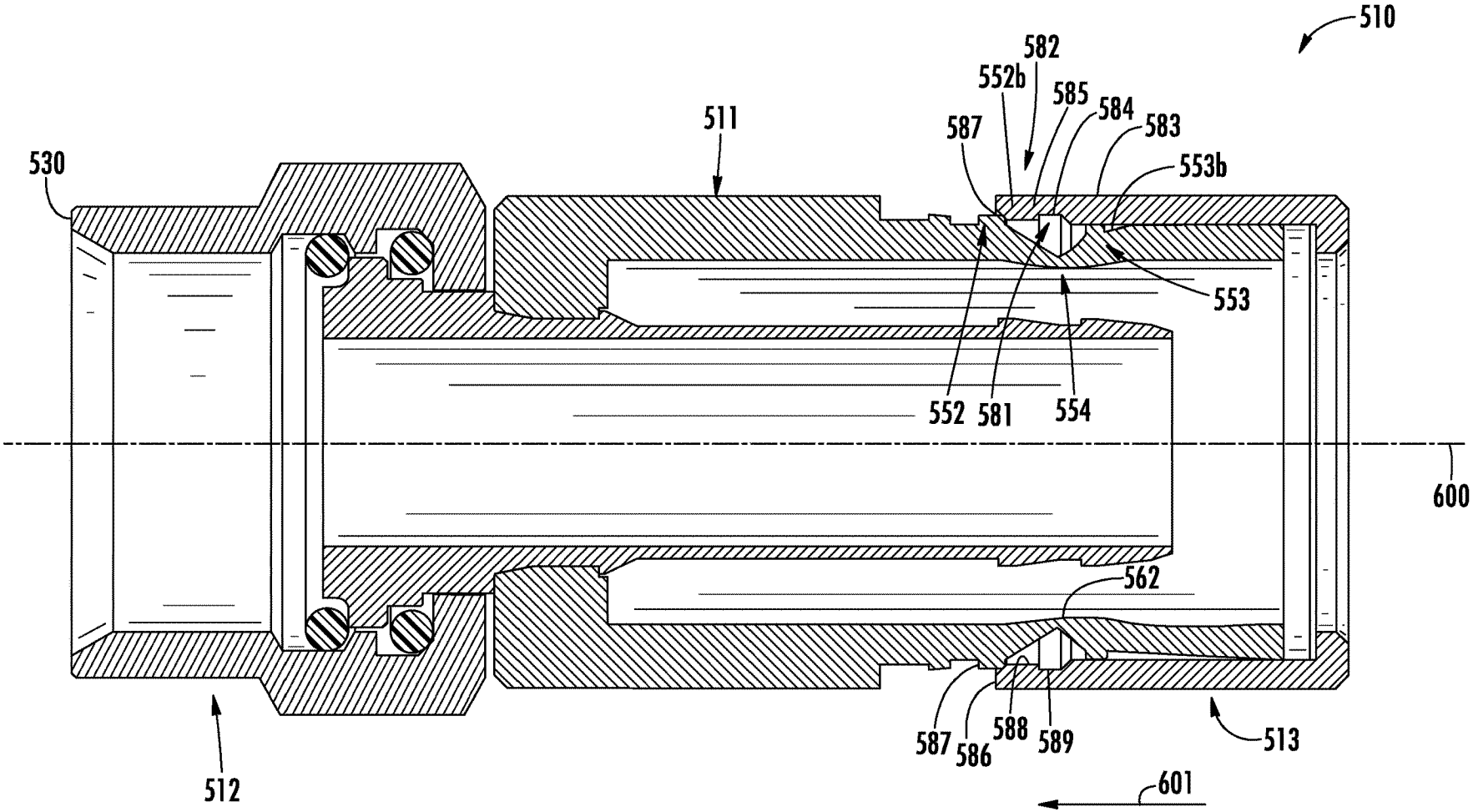

FIG. 14 illustrates the compression collar 513 advanced to an extent that the ring 582 is brought forward to the intermediate ridge 552. The oblique face 587 impacts the rear face 552*b* of the intermediate ridge 552. This forces the intermediate ridge 552 radially inward, further causing the notch 554 to collapse. While the intermediate ridge 552 is forced radially inward, the rearward ridge 553 slides within the inner surface 543 and is pushed further radially inward. The combined action on the intermediate and rearward ridges 552 and 53 continue the collapse and deformation of the notch 554.

Movement of the compression collar 513 from the retracted position toward the advanced position brings the compression collar 513 into engagement with the rearward ridge 553, with the intermediate ridge 552, and with the notch 554 of the sidewall 542, and these engagements urge the sidewall 542 into deformation at the compression band 550 of the compression collar 513. The notch 554 of the sidewall 542 is therefore urged into deformation and axial compression by the compression collar 513 at both its front and rear ends. The bend point 562 deforms radially inward, toward the jacket of the coaxial cable.

Figure 15:
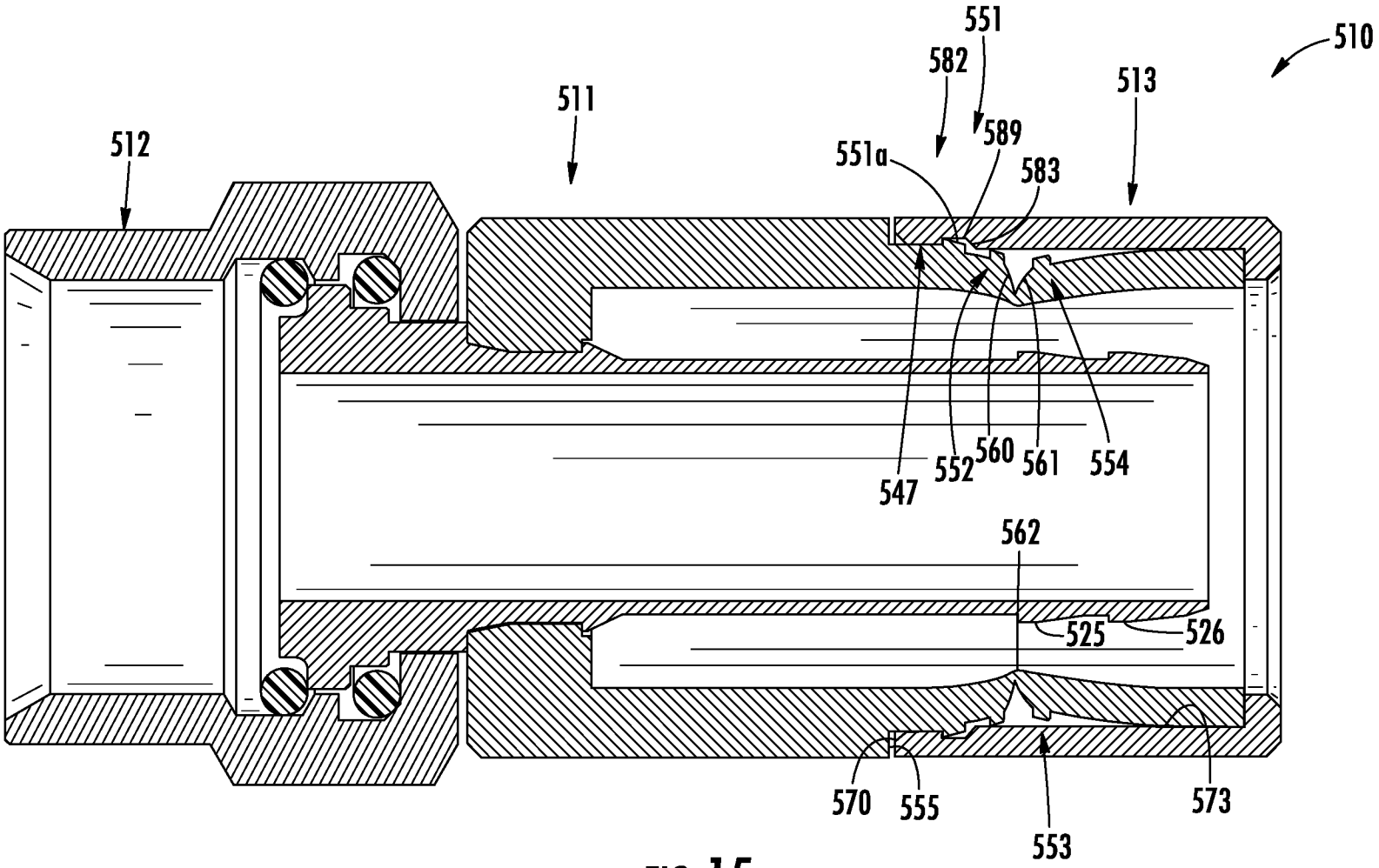

Continued forward movement of the compression collar 513 over the barrel 511 along the line 601 moves the compression collar 513 into the advanced position thereof, as shown in FIGS. 15 and 17. In the advanced position of the compression collar 513, the compression collar 513 is slid fully over the barrel 511, and the front end 570 of the compression collar 513 is in contact against the shoulder 555 of the barrel 511. The description below describes final movement of the compression collar into the advanced position from FIG. 16 to FIG. 17 (and from FIG. 14 to FIG. 15).

The ring 582 is snappedly received and seated into an annular groove 547 in front of the forward ridge 551, just between the shoulder 555 and the forward ridge 551. As the compression collar 513 is advanced forwardly, the ring 582 expands slightly to accommodate the outer diameter of the barrel 511 at the intermediate ridge 552. Continued forward movement moves the ring 582 over the forward ridge 551 as well, snapping over the forward ridge 551 as it passes. Once the ring 582 has snapped over the forward ridge 551, it is received and seated in the groove 547 between the forward ridge 551 and the shoulder 555. The rear face 589 of the ring 582 is received against the front face 551*a* of the forward ridge 551, preventing the compression collar 513 from being drawn back out of the advanced position. The corner formed between the rear face 551*b* and the outer face 551*c* is acute and catches the rear face 589, thereby preventing rearward movement of the compression collar 513 off the barrel 511.

As the compression collar 513 is brought into the advanced position, the compression band 550 finishes its radial deformation. The oblique rear face 583 urges the intermediate ridge 552 slightly radially inward, thereby pushing the notch 554 into the interior of the connector 510 and into the coaxial cable, until the notch 554 is fully deformed, collapsed so that the oblique first and second face 560 and 561 of the notch 554 are in confrontation with each other, in direct, flush, and coextensive contact. The bend point 562 is pushed radially inward and extends into the jacket of the coaxial cable, "biting" into it similarly to an annular barb, so as to engage the jacket and prevent relative axial movement of the jacket and the bend point 562 (and thus the barrel 511).

With the compression band 550 deformed, the front corner of the forward ridge 551 and the back corner of the rearward ridge 553 are directed radially outward into biting engagement with the inner surface 573 of the compression collar 513, thereby preventing relative axial movement of the barrel 511 and the compression collar 513. In other words, the forward and intermediate ridges 551 and 53 bite into the inner surface 573 of the compression collar 513 in the same manner in which a barb does: each projects into the inner surface 573 with a sharp edge which prevents relative axial movement of the inner surface 573 and the respective forward and intermediate ridges 551 and 552.

In short, several engagements prevent relative movement of the compression collar 513, the barrel 511, and the coaxial cable 590: the snapped seating of the ring 582 in the groove 547 between the shoulder 555 and the forward ridge 551, the biting engagement of the bend point 562 into the jacket, and the biting engagement of the forward and intermediate ridges 551 and 552 into the compression collar 513. Further, opposed from and axially flanking the bend point 562 are the ridges 525 and 526 on the inner post 514. The cable is compressed between the decreased annular space of the deformed notch 554 and the ridges 525 and 526. Thus, the annular ridges 525 and 526 prevent retraction of the cable on the inner post 514. In this manner, the connector 510 is secured on the coaxial cable, and the connector 510 is ready for application to an electronic component.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that modifications do not depart from the spirit of the invention, they are intended to be included within the scope thereof.

The invention claimed is:

1. A coaxial cable connector comprising:

a barrel including a longitudinal axis, a front end, and an annular sidewall extending rearwardly from the front end of the barrel along the longitudinal axis;

a compression band in the sidewall, the compression band including a thinned portion of the sidewall and annular first and second ridges flanking the thinned portion;

an annular forward ridge formed in the sidewall in front of the first ridge; and a compression collar mounted to the barrel for axial movement between a retracted position and an advanced position in which the sidewall is deformed radially inward only at the compression band.

2. The coaxial cable connector of claim 1, further comprising an outer surface of the sidewall, wherein the annular forward, first, and second ridges are formed on the outer surface.

3. The coaxial cable connector of claim 1, wherein the compression collar includes a front end, an inner surface, and a ring formed at the front end of the compression collar and extending radially inward from the inner surface, thereby defining a constricted mouth of the compression collar.

4. The coaxial cable connector of claim 3, further comprising an annular groove in the sidewall in front of the forward ridge, wherein the ring is seated in the groove when the compression collar is in the advanced position.

5. The coaxial cable connector of claim 1, wherein the first and second ridges each include axially-directed front and rear faces normal to the sidewall and a circumferential outer face extending between and normal to the front and rear faces thereof.

6. The coaxial cable connector of claim 5, wherein the forward ridge includes axially-directed front and rear faces normal to the sidewall and a circumferential outer face extending between the front and rear faces thereof.

7. The coaxial cable connector of claim 5, wherein the thinned portion of the sidewall comprises a first oblique outer face and a second oblique outer face which converge toward a bend point.

8. The coaxial cable connector of claim 1, wherein in the advanced position of the compression collar, the forward ridge is disposed in an annular groove formed in the compression collar behind the ring, engaged therein and preventing the compression collar from moving back to the retracted position.

9. A coaxial cable connector comprising:

a barrel including a longitudinal axis, a front flange, an annular sidewall extending rearwardly from the front flange of the barrel along the longitudinal axis, and a compression band in the sidewall, wherein the compression band includes a thinned portion of the sidewall, annular first and second ridges flanking the thinned portion, and an annular forward ridge formed in the sidewall in front of the first ridge;

a compression collar mounted to the barrel for axial movement between a retracted position and an advanced position, the compression collar including an inner surface and an inwardly-directed ring extending beyond the inner surface;

in the retracted position of the compression collar, the ring of the compression collar is between the first and second ridges, located at the thinned portion of the sidewall; and in the advanced position of the compression collar, the ring is in front of the forward, first, second ridges, and the sidewall is deformed radially inward at the compression band.

10. The coaxial cable connector of claim 9, wherein the sidewall is deformed only at the compression band when the compression collar is in the advanced position.

11. The coaxial cable connector of claim 9, further comprising an annular groove in the sidewall, wherein the ring of the compression collar is seated in the groove when the compression collar is in the advanced position.

12. The coaxial cable connector of claim 9, wherein the ring of the compression collar is formed at a front end of the compression collar, defining a constricted mouth of the compression collar.

13. The coaxial cable connector of claim 9, further comprising an outer surface of the sidewall, wherein the first and second ridges are formed on the outer surface.

14. The coaxial cable connector of claim 9, wherein the first and second ridges each include axially-directed front and rear faces normal to the sidewall and a circumferential outer face extending between and normal to the front and rear faces.

15. The coaxial cable connector of claim 14, wherein the forward ridge includes axially-directed front and rear faces normal to the sidewall and a circumferential outer face extending between the front and rear faces thereof.

16. The coaxial cable connector of claim 14, wherein the thinned portion of the sidewall comprises a first oblique outer face and a second oblique outer face which converge toward a bend point.

17. The coaxial cable connector of claim 9, wherein in the advanced position of the compression collar, the forward ridge is disposed in an annular groove formed in the compression collar behind the ring, engaged therein and preventing the compression collar from moving back to the retracted position.

18. A coaxial cable connector comprising:

a barrel including a longitudinal axis, a front flange, an annular sidewall extending rearwardly from the front flange of the barrel along the longitudinal axis, and a compression band in the sidewall, wherein the compression band includes a thinned portion of the sidewall and annular first and second ridges flanking the thinned portion, and an annular forward ridge formed in the sidewall in front of the first ridge; and a compression collar mounted to the barrel for axial movement between a retracted position and an advanced position;

wherein movement of the compression collar from the retracted position toward the advanced position brings the compression collar into engagement with the first and second ridges, both of said engagements urging the sidewall into deformation at the compression band as the compression collar moves from the retracted position toward the advanced position.

19. The coaxial cable connector of claim 18, wherein the engagements urge the sidewall into deformation at the compression band only.

20. The coaxial cable connector of claim 18, wherein the compression collar includes a front end, an inner surface, and a ring formed at the front end of the compression collar and extending radially inward from the inner surface, thereby defining a constricted mouth of the compression collar.

21. The coaxial cable connector of claim 20, further comprising an annular groove in the sidewall of the barrel proximate to the front flange, wherein the ring of the compression collar is seated in the groove when the compression collar is in the advanced position.

22. The coaxial cable connector of claim 18, further comprising an outer surface of the sidewall, wherein the first and second ridges are formed on the outer surface.

23. The coaxial cable connector of claim 18, wherein the first and second ridges each include axially-directed front and rear faces normal to the sidewall and a circumferential outer face extending between and normal to the front and rear faces.

24. The coaxial cable connector of claim 23, wherein the forward ridge includes axially-directed front and rear faces normal to the sidewall and a circumferential outer face extending between the front and rear faces thereof.

25. The coaxial cable connector of claim 23, wherein the thinned portion of the sidewall comprises a first oblique outer face and a second oblique outer face which converge toward a bend point.

26. The coaxial cable connector of claim 18, wherein in the advanced position of the compression collar, the forward ridge is disposed in an annular groove formed in the compression collar behind the ring, engaged therein and preventing the compression collar from moving back to the retracted position.

* * * * *